US012798826B2

(12) United States Patent
Dotterweich

(10) Patent No.: US 12,798,826 B2
(45) Date of Patent: Nov. 17, 2026

(54) CONTAINER FOR STORAGE AND SHIPPING

(71) Applicant: Michael Thomas Dotterweich, Shortsville, NY (US)

(72) Inventor: Michael Thomas Dotterweich, Shortsville, NY (US)

( * ) Notice: Subject to any disclaimer, the term of this patent is extended or adjusted under 35 U.S.C. 154(b) by 0 days.

(21) Appl. No.: 18/791,340

(22) Filed: Jul. 31, 2024

(65) Prior Publication Data

US 2025/0042605 A1 Feb. 6, 2025

Related U.S. Application Data

(60) Provisional application No. 63/677,397, filed on Jul. 30, 2024, provisional application No. 63/530,061, filed on Jul. 31, 2023.

(51) Int. Cl.
*B65D 6/22* (2006.01)
*B65D 6/26* (2006.01)
*B65D 6/34* (2006.01)

(52) U.S. Cl.
CPC *B65D 9/24* (2013.01); *B65D 9/34* (2013.01)

(58) Field of Classification Search
CPC ... B65D 9/22; B65D 9/12; B65D 9/24; B65D 9/34; B65D 11/1873
USPC ..... 220/4.28
See application file for complete search history.

(56) References Cited

U.S. PATENT DOCUMENTS 1,133,001 A 3/1915 Brown
1,956,768 A 5/1934 Kubes
2,184,854 A 12/1939 Spooner
2,549,509 A 4/1951 Munroe
2,593,779 A 4/1952 Mcgrath et al.
2,833,005 A * 5/1958 Barry ..... B65D 25/20 217/43 A
2,979,027 A * 4/1961 Corwin ..... B65D 9/12 119/513

(Continued)

FOREIGN PATENT DOCUMENTS

DE 29619630 U1 6/1997
KR 101946815 B1 2/2019

OTHER PUBLICATIONS

International Patent Application No. PCT/US2024/040472, International Search Report and Written Opinion, Dec. 19, 2024.

*Primary Examiner* — Stephen J Castellano
(74) *Attorney, Agent, or Firm* — Kenneth J. LuKacher Law Group; R.S. Rosenholm

(57) ABSTRACT

The invention is an article of manufacturing, being an improved design for a container that can be manufactured in a way that reduces an amount of material, and reduces an amount of monetary cost, time, human effort and risk of injury that are typically required for manufacturing and assembling together components that are required for constructing a traditional container. This improved container is also reusable and recyclable and can be disassembled and re-assembled without requiring use of invasive methods or penetrating fasteners, so as to maximize reusability and to minimize space requirements when not in use. This improved container design also provides ecological benefits given that it reduces an amount of consumption of material resources in relation to that of more traditional container designs.

19 Claims, 25 Drawing Sheets

(56) References Cited

U.S. PATENT DOCUMENTS

| | | | | | |
|---|---|---|---|---|---|
| 3,414,152 | A | * | 12/1968 | Overton, III | B65D 9/12 217/69 |
| 3,877,602 | A | | 4/1975 | Clark et al. | |
| 4,251,006 | A | | 2/1981 | Smith | |
| 4,673,087 | A | | 6/1987 | Webb | |
| 4,974,773 | A | | 12/1990 | Alexander et al. | |
| 5,529,199 | A | * | 6/1996 | Foster | B65D 11/1873 220/4.28 |
| 5,645,329 | A | * | 7/1997 | Madock | A47B 81/068 312/9.11 |
| 5,669,507 | A | | 9/1997 | Pruitt, Jr. | |
| 5,899,337 | A | | 5/1999 | Thebeault | |
| 6,155,772 | A | * | 12/2000 | Beale | B65D 90/205 383/117 |
| 2003/0123965 | A1 | | 7/2003 | Brackmann et al. | |
| 2003/0183544 | A1 | | 10/2003 | Lawrence | |
| 2004/0182048 | A1 | | 9/2004 | Matsumoto et al. | |
| 2006/0260972 | A1 | | 11/2006 | Ayres | |
| 2011/0309072 | A1 | | 12/2011 | Rio Gonzalez et al. | |
| 2018/0222628 | A1 | * | 8/2018 | Akhavan-Tabassi | B65D 7/24 |
| 2020/0246657 | A1 | | 8/2020 | Wittenbrink | |
| 2022/0348380 | A1 | | 11/2022 | Austin et al. | |

* cited by examiner

CONTAINER FOR STORAGE AND SHIPPING

This document is a United States Non-Provisional utility patent application being filed under statute 35 U.S.C. 111(a), and that claims priority and benefit to Ser. No. 63/530,061, (Confirmation No. 8872), that was filed on Jul. 31, 2023, and that is entitled "Improved Container".

This document also claims priority and benefit to Ser. No. 63/677,397, (Confirmation No. 7338), that was filed on Jul. 30, 2024, and that is entitled "Improved Container for Storage and Shipping". All of the above referred to documents are incorporated herein by reference in their entirety, for any and all purposes.

FIELD OF THE INVENTION

The present invention relates to improved containers for storage and shipping, and particularly to, containers for storage and shipping that each incorporate upper and lower walls that include a channel that is cut and routed to receive a plurality of side walls (and optionally) corner components, and including a cavity for receiving side walls) that form the container without requiring installation of any penetrating types of fasteners or application of adhesive materials, but instead can rely upon at least one band or strap that applies a constricting tensile force looping around the container, and looping around the upper and lower walls and around two opposing side walls that structurally integrates and seals the container in a closed configuration. In some embodiments of the container, the band makes no physical contact with opposing side walls, and in other embodiments, slots (apertures) are provided through both top and bottom walls through which the band extends so that the band may optionally touch such opposing side walls when looped there around, to seal a closed container. The containers of the present invention are useful as their walls can be made of rigid materials, such as of wood or rigid plastic, which can be reused and are recyclable as penetrating fasteners and adhesives are not required for assembly/constructions of the container.

BACKGROUND OF THE INVENTION

A container is an object that can be used to enclose and/or transport something. The something that is enclosed (held) and/or transported by a container is also referred to as content of the container. Containers are designed to enclose/hold/store various types of content, and can be transported via various types of methods between locations. Some containers are designed to be carried by fork-lift machines, and these types of containers are referred to as crates.

BRIEF DESCRIPTION OF THE INVENTION

The invention is an article of manufacturing, being an improved design for a container. This container is designed to be re-usable, and can be disassembled and returned to its sender, and can be re-assembled without requiring use of tools, invasive methods, nor use of an adhesive, and without requiring use (installation) of penetrating fasteners, nor application of an adhesive, in order to maximize reusability of the container and to minimize space requirements when the container is not in use. This container can be employed in combination with a pallet to form a crate that in combination can be transported via a fork lift machine. This improved container design also provides ecological benefits given that it is designed to reduce an amount of consumption of material resources in relation to that of more traditional container designs. This container can also be manufactured from a variety of material, including recyclable material, yielding benefits to the environment.

Further, this container is designed so that it requires a reduced amount of material in relation to that of other traditional and/or typical container designs, and it can be almost entirely manufactured via computer numerical control (CNC) automatic cutting and routing machines, and further, requires a reduced amount of human effort for its manufacture, as compared to other typical container designs. And further, the type and amount of human effort currently required for its manufacture and use causes a reduced amount of risk of injury, and a relatively low risk of injury, as compared to that required of other traditional and/or typical container designs.

This brief description of the invention is intended only to provide an overview of subject matter disclosed herein according to one or more illustrative embodiments, and does not serve as a guide to interpreting the claims or to define or limit the scope of the invention, which is defined only by the appended claims.

BRIEF DESCRIPTION OF THE DRAWINGS

So that the manner in which the features of the invention can be understood, a detailed description of the invention to certain embodiments of the invention is provided herein, some of which are illustrated in the accompanying drawings. It is to be noted, however, that the drawings illustrate only certain embodiments of this invention and are therefore not to be considered limiting of the scope of the invention, for the scope of the invention can encompass other effective embodiments.

The drawings are not necessarily to scale. The emphasis of the drawings is generally being placed upon illustrating the features of certain embodiments of the invention. In the drawings, like numerals are used to indicate like parts throughout the various views. Differences between like parts may cause those parts to be indicated with different drawing reference numerals. Unlike parts, if indicated with drawing reference numerals, are to be indicated with different drawing reference numerals. Thus, for further understanding of the invention, reference can be made to the following detailed description, read in connection with the drawings in which.

DETAILED DESCRIPTION OF THE INVENTION

Figure 1A:
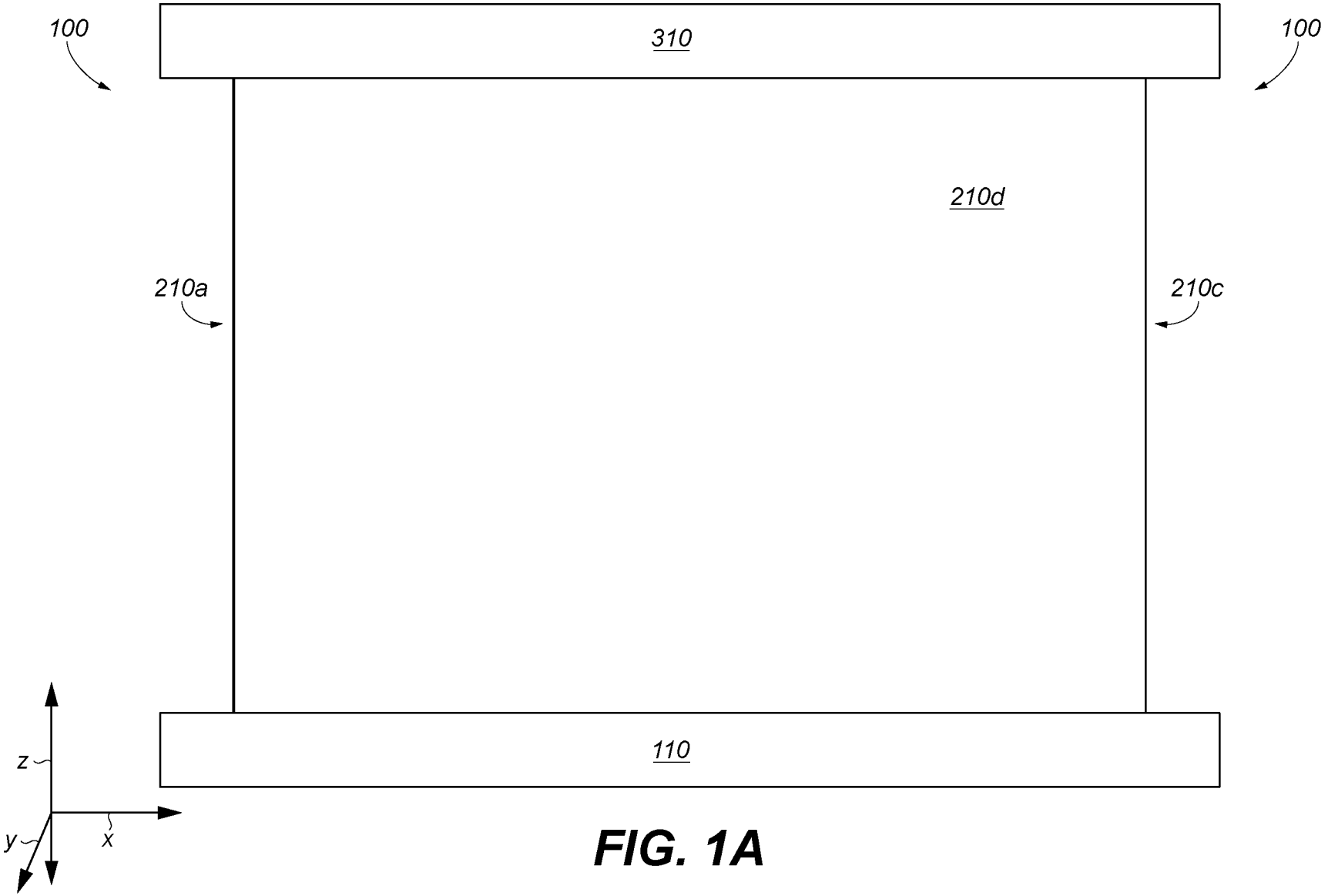
FIGS. 1A, 1B, and 1C (FIGS. 1A-1C) each illustrate different viewing perspectives of an embodiment of a container and an embodiment of a lower wall within that container.
Figure 1B:
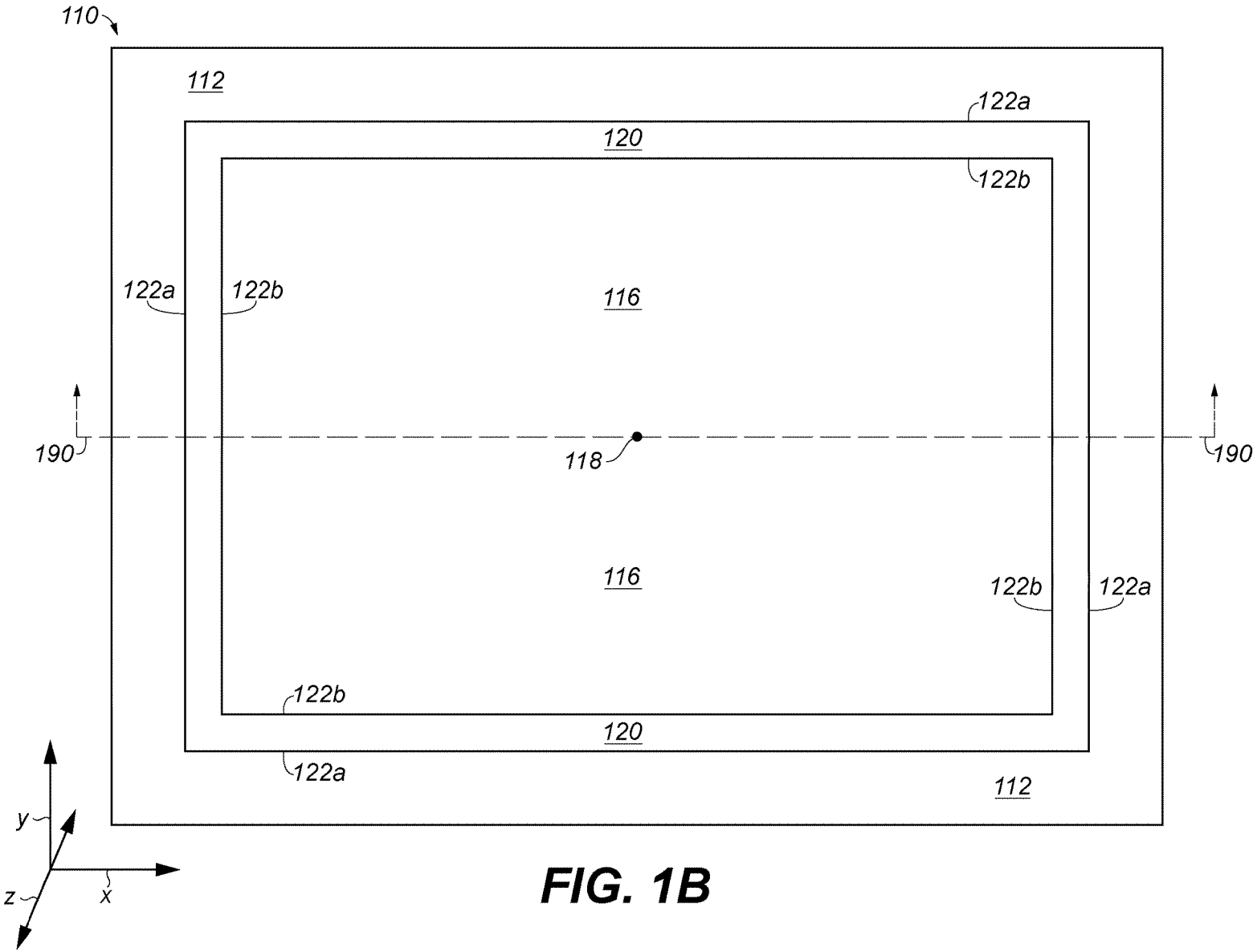
Figure 1C:
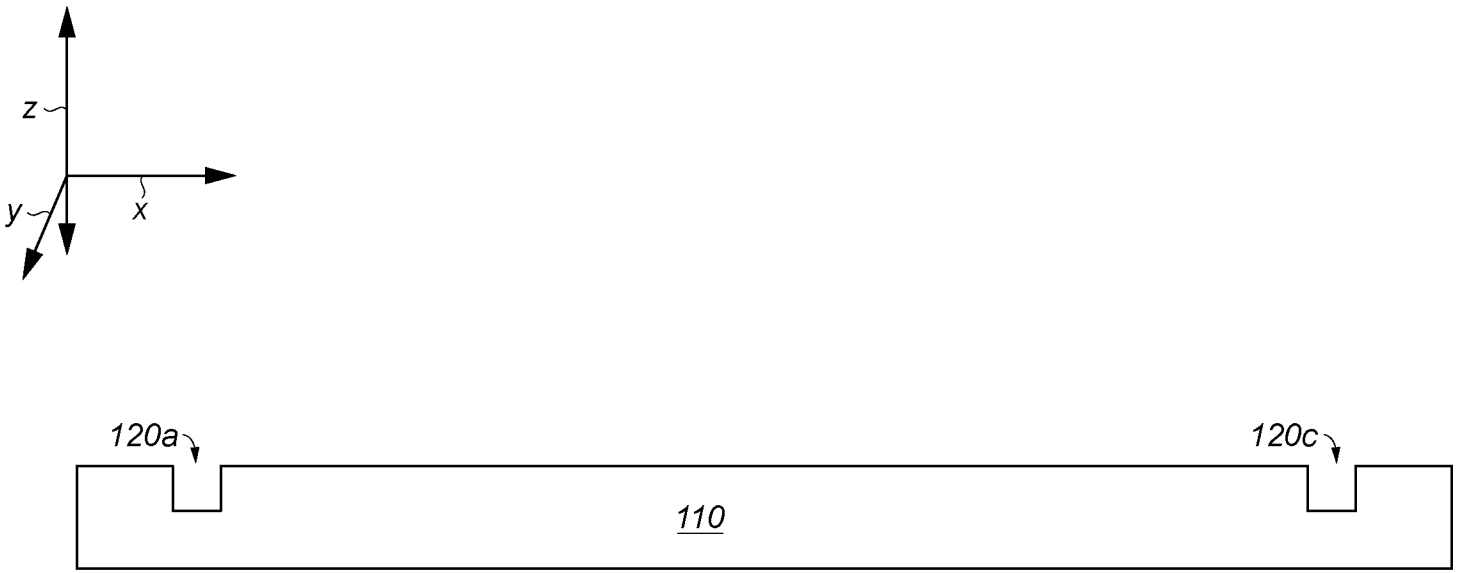

FIGS. 1A, 1B and 1C (FIGS. 1A-1C) each illustrate different viewing perspectives of a first embodiment of a container, and an embodiment of a lower wall within that container.

FIG. 1A illustrates a horizontal side perspective view of an assembled (constructed) container 100. As shown, the container 100 includes an upper wall 310, four side walls 210*a*, 210*b*, 210*c* and 210*d* (210*a*-210*d*) and a lower wall 110. A broad side of side wall 210*d* is shown here. Broad sides of side walls 210*a* and 210*c* are not facing the viewer from the viewing perspective of this figure. A broad side of side wall 210*b* is obstructed by the broad side of the side wall 210*d*, and as a result, is not visible to the viewer from the viewing perspective of this figure.

FIGS. 1B-1C each illustrate different viewing perspectives of the lower wall 110 of an embodiment of a container of FIG. 1A. The lower wall 110 is also referred to herein as a bottom wall 110 or as a floor 110 of the container 100. The container 100 is also referred to herein as a structure, storage structure or storage box.

FIG. 1B illustrates a top-down viewing perspective of the lower wall 110 of the container 100. This viewing perspective requires that the upper wall 310 and the side walls 210*a*-201*d*, be removed from the assembled container 100 to expose an upward facing surface of the lower wall 110 of the container 100.

As shown, this lower wall 110 has a planar three-dimensional shape. This planar shape of the lower wall 110 having two broad (and) opposing sides. These two broad (and) opposing sides include an upward facing side (shown here) and a downward facing side (not shown here).

Referring to FIG. 1A, this upward facing side of the lower wall 110 is obstructed by the side walls 210*a*, 210*b*, 210*c* and 210*d* (210*a*-210*d*) of FIG. 1A, and consequently, not shown in FIG. 1A. This upward facing side has an outer perimeter, and this side includes a channel 120 that is cut into the lower wall 110, and more specifically cut into an outer surface of the upward facing side of the lower wall 110.

As shown here, the upward facing outer surface of the lower wall 110 is oriented substantially parallel to a plane defined by the X and Y axes, as shown in this figure. Also, the viewing perspective of this figure being in a direction that is substantially downward and parallel to the Z axis, and perpendicular to a plane defined by the X and Y axes for this figure.

As shown here, this channel 120 has a perimeter that forms a shape, being that of a rectangle. Likewise, the lower wall 110 also has a perimeter that forms a shape, being that of a rectangle. The shape formed by the channel 120 is also referred to herein as a shape of the channel perimeter, or as a shape characteristic of the channel 120, or as the channel perimeter shape. Likewise, the shape formed by the perimeter of the lower wall 110 is also referred to herein as a shape of the lower wall perimeter, or as a shape characteristic of the lower wall 110, or as a lower wall perimeter shape.

In this embodiment, the channel perimeter has a shape of a rectangle. Likewise, the outer perimeter of the lower wall 110, also has the shape of a rectangle. In this circumstance, both the shape characteristic of the perimeter of the lower wall 110 and of the shape characteristic of the perimeter of the channel 120, have the same type of shape, being that of a rectangle, and further, each having a same length and width proportion of the rectangular shape that is formed.

The portion of the upper surface of the lower wall 110 that is located between the outer perimeter of the lower wall 110 and the channel 120 of the lower wall 110, is referred to herein as a perimeter plateau 112 of the lower wall 110. Separately from the perimeter plateau 112, the upper surface portion of the lower wall 110 that is surrounded by and located inside of the channel 120 of the lower wall 110, is referred to herein as a center plateau 116 or as a central plateau 116 of the lower wall 110. This center plateau 116 includes a center point location 118.

In accordance with the invention, the shape characteristic of the channel 120 and the shape characteristic of the lower wall 110, are not required to be that of a rectangle, nor are these shapes required to be the same type of shape, nor are these shapes required to have same proportions if both have the same shape. Further, although the channel 120 is shown as having uniform width, which is desirable to receive (interface with) a side wall having a uniform width, there are other embodiments of the invention, (See FIG. 6F) for example, that are designed to not include a channel 614 having a uniform width, as shown for example in FIG. 6F.

Other embodiments of the invention can include a lower wall 110 having an outer perimeter shape that is different than that of a rectangle, and likewise, the channel (groove) may also have a perimeter shape that is different than that of a rectangle. Furthermore, in some embodiments, the shape characteristic of the channel 120 and that of the lower wall 110 can be different from each other, or have the same shape characteristic, with different proportions and/or dimensions.

FIG. 1B further includes a horizontal dashed line 190 that indicates a cross-sectional viewing perspective 190 of the lower wall 110 of FIG. 1A, from a horizontal side viewing perspective that is shown in FIG. 1C. This cross-sectional and horizontal viewing perspective is in a direction that is substantially parallel to the Y axis, as shown here in FIG. 1B.

FIG. 1C illustrates a horizontal side cross-sectional viewing perspective of the lower wall 110 of FIGS. 1A and 1B, being indicated by the horizontal dashed line 190 of FIG. 1B. As shown, the channel itself 120 that is cut into the lower wall 110, has a cross-sectional profile 120*a* and 120*b* (120*a*-120*b*) that is also rectangular in shape. This cross-sectional profile 120*a* and 120*b* (120*a*-120*b*) of the channel 120 is dimensioned (shaped and sized) to receive an outer edge of a plurality of side walls (not shown here), that are each configured to be inserted into the channel 120. (Shown in FIG. 2A)

Preferably, the cross-section of the channel 120 is uniform and dimensioned so that each side wall that is inserted into the channel 120, is supported as standing in a vertically upright position (self-standing), and not requiring any additional support, for maintaining such a stationary and vertically upright position. In some embodiments, the width of the channel 120, as measured parallel to the X axis from this cross-sectional viewing perspective, is ½ (16/32) of an inch, which can receive a side wall that is 15/32 of an inch wide, as measured parallel to the X axis.

Figure 2A:
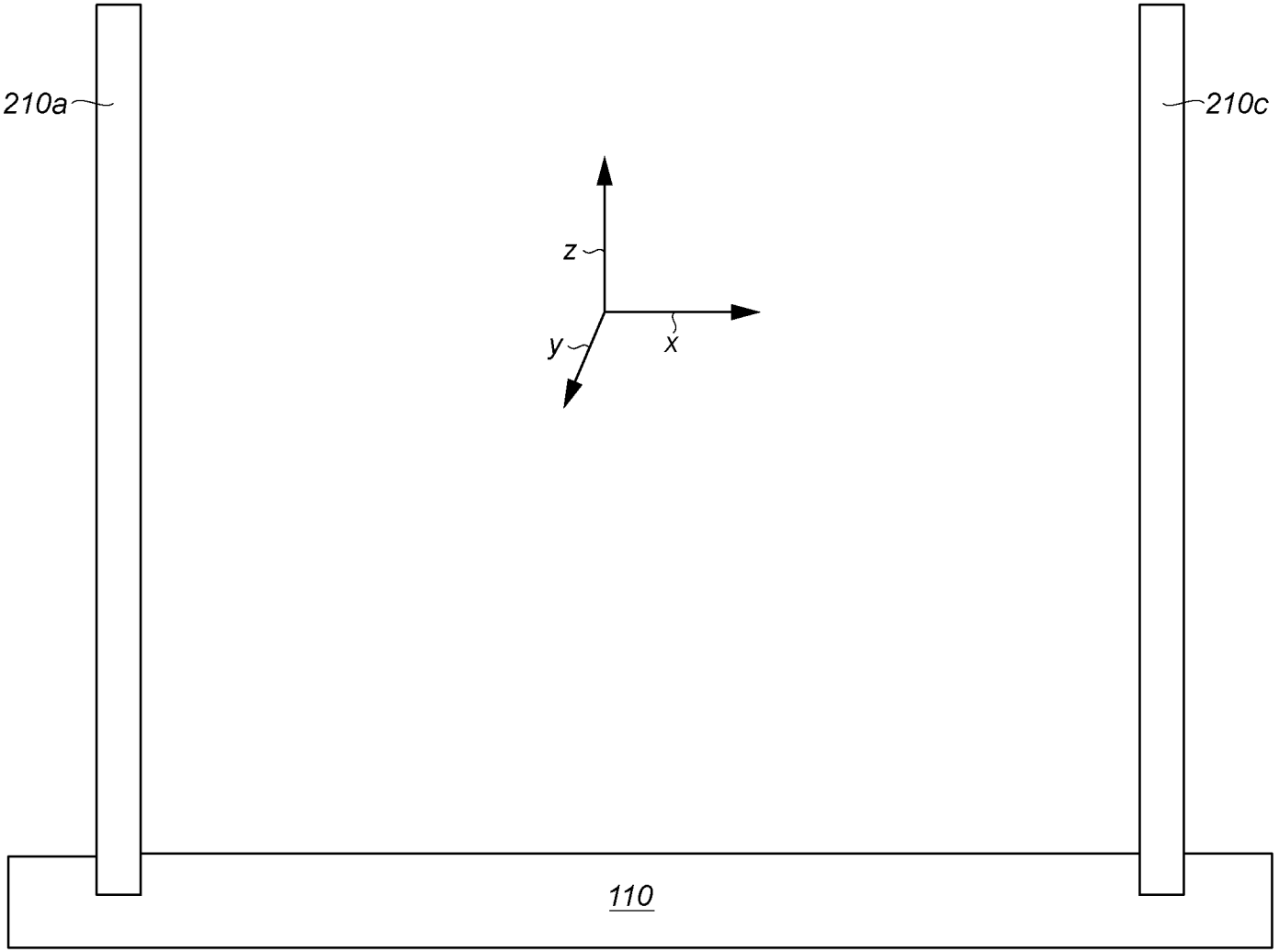
FIGS. 2A, 2B and 2C (FIGS. 2A-2C) each illustrate different viewing perspectives of a partially constructed container of FIG. 1A.
Figure 2B:
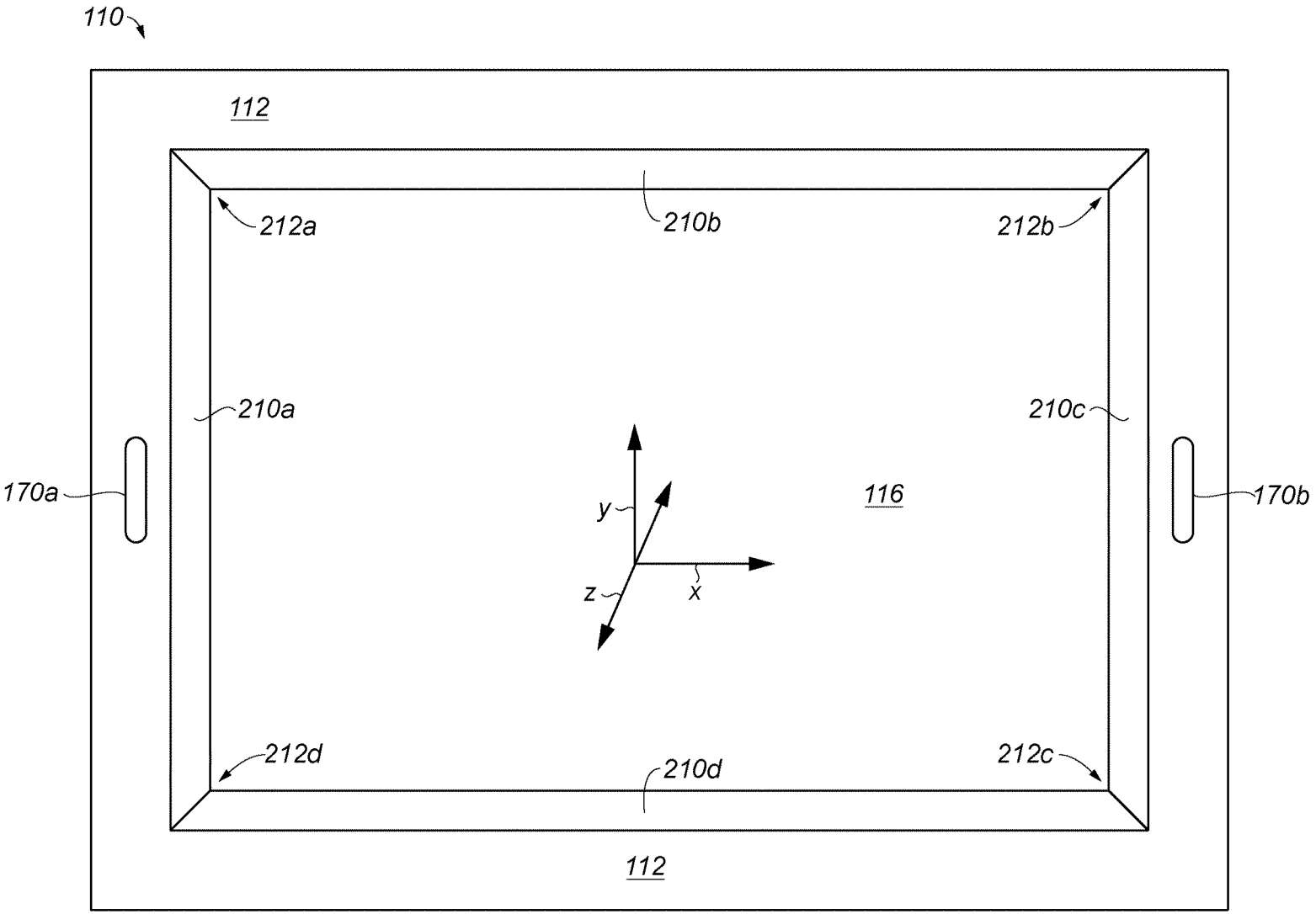
Figure 2C:
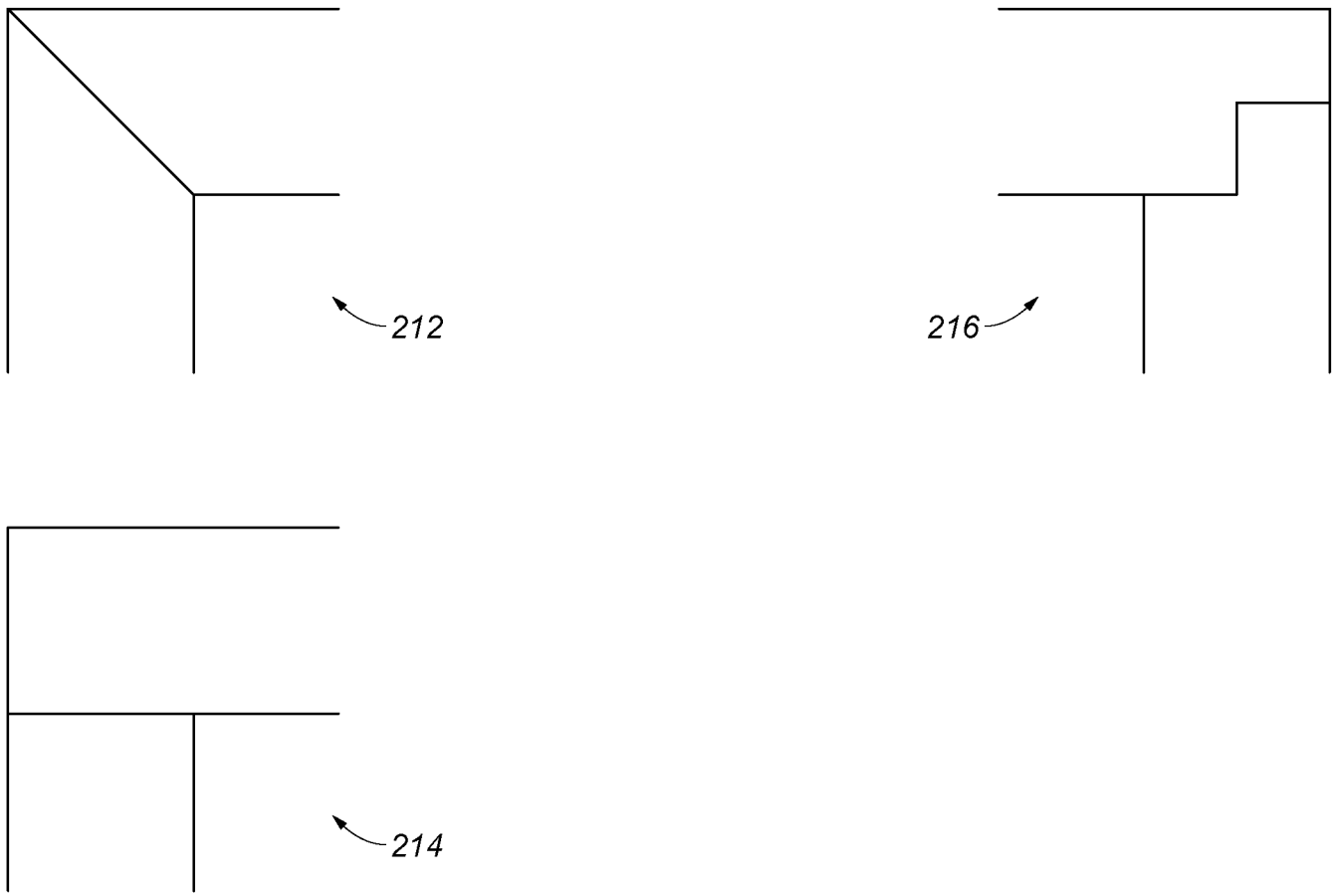

FIGS. 2A, 2B and 2C (FIGS. 2A-2C) each illustrate different viewing perspectives of a partially constructed container of FIG. 1A.

FIG. 2A illustrates a side cross-sectional view of a lower edge of each of two side walls 210*a*, 210*c* being inserted into the lower wall 110 of FIGS. 1A-1C. The lower wall 110 of FIGS. 1A-1B is shown from the side cross-sectional viewing perspective of FIG. 1C. As shown, each of the side walls 210*a* and 210*c* is standing upright while being inserted into the channel 120 of the lower wall 110 of the container 100. Notice that, and preferably, no additional structure is required for each side wall 210*a* and 210*c*, to maintain a stationary and upright position, which is a preferred embodiment of the invention. Each of the side walls 210*a*-210*d* are rectangular and planar in shape, and each have two broad (and) opposing sides, and each have a plurality of edge sides that are located in between each of their two broad (and) opposing sides.

The embodiment of the lower wall 110 of FIGS. 1A-1B is configured to receive four (4) side walls (210*a*-210*d*). However, because FIG. 2A is a cross-sectional view of a partially constructed storage structure 100, the side walls 210*a* and 210*c* that are shown here are limited to being a cross-sectional view of two (2) of the four (4) side walls. The cross-sectional view of the side walls 210*a* and 210*c* that is shown in FIG. 2A, are side walls that each have a broad side (surface) that is oriented substantially parallel to a plane formed by the Y and Z axes. Side walls that are not shown here, being side walls 210*b* and 210*d*, each have a broad side (surface) that is oriented substantially parallel to the X and Z axis.

FIG. 2B illustrates a top-down view of a partially constructed container 100 with four (4) standing side walls, while each of the side walls 210*a*-210*d* are inserted into the channel (120) of the lower wall 110 of FIGS. 1A-1C. From this viewing perspective, a view of the channel 120 is obstructed by the side walls 210-210*d* that are inserted into the channel 120. The container 100 is partially constructed because the upper wall 310 of FIG. 1A is absent from this figure, because it has not yet been placed (attached) above the side walls 210*a*-210*d*, to form an enclosed container 100, like that shown in FIG. 1A. In this figure, all four (4) of the side walls 210*a*-210*d* are inserted into the channel 120 of the lower wall 110 of this container 100.

In this embodiment, notice that each of the side walls 210*a*-210*d*, makes physical contact with two other adjacent side walls 210*a*-210*d* along a beveled edge 212 of each side wall 210*a*-210*d*, making physical contact with another 210*a*-210*d*. Each beveled edge 212*a*-212*d* is a beveled side edge, as opposed to a lower or upper edge, of each side wall 210*a*-210*d*. Such a beveled side edge is optional, and the invention does not require a beveled edge 212*a*-212*d* for physical contact between the side walls 210*a*-210*d*.

In this example, the bevel edge 212*a*-212*d* has an angle equal to 45 degrees. A 45-degree bevel angle is preferred to physically interface a 90-degree corner angle. However, as will be shown in FIG. 5A, other container shapes, such as a triangle shaped container, will include corners that are not of a 90-degree angle. Such corners, if beveled, will likely have a bevel angle that is other than a 45-degree angle.

As shown, the lower wall 110 includes apertures (passageway/slots/holes) 170*a* and 170*b* that are each designed (configured) to receive a band 446 or strap 442 (not shown here). These apertures 170*a*-170*b* are also included in the upper wall 310, as shown in FIGS. 3A-3B.

Figure 3A:
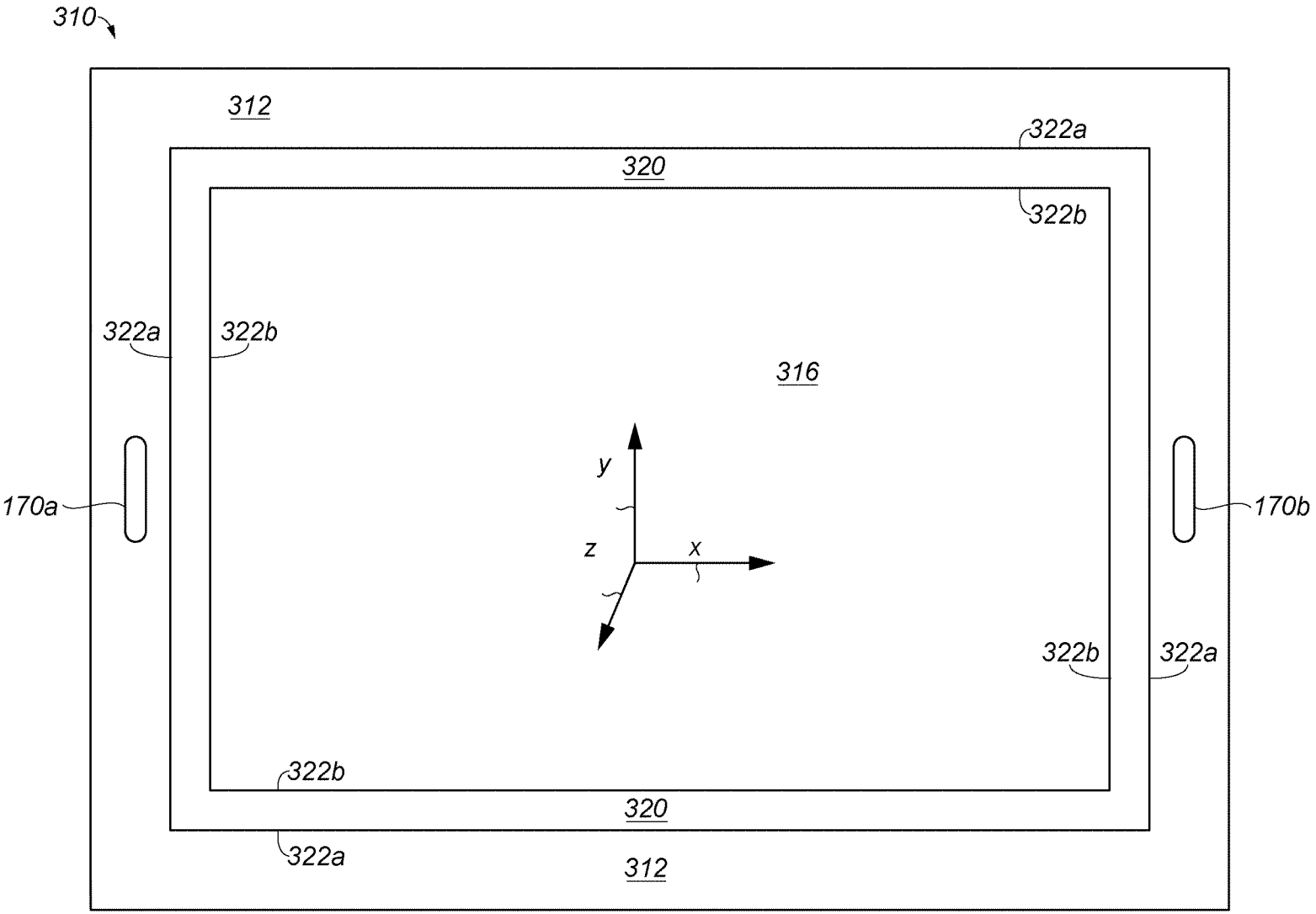
FIGS. 3A and 3B (FIGS. 3A-3B) each illustrate different viewing perspectives of an upper wall of the container of FIG. 1A.
Figure 3B:
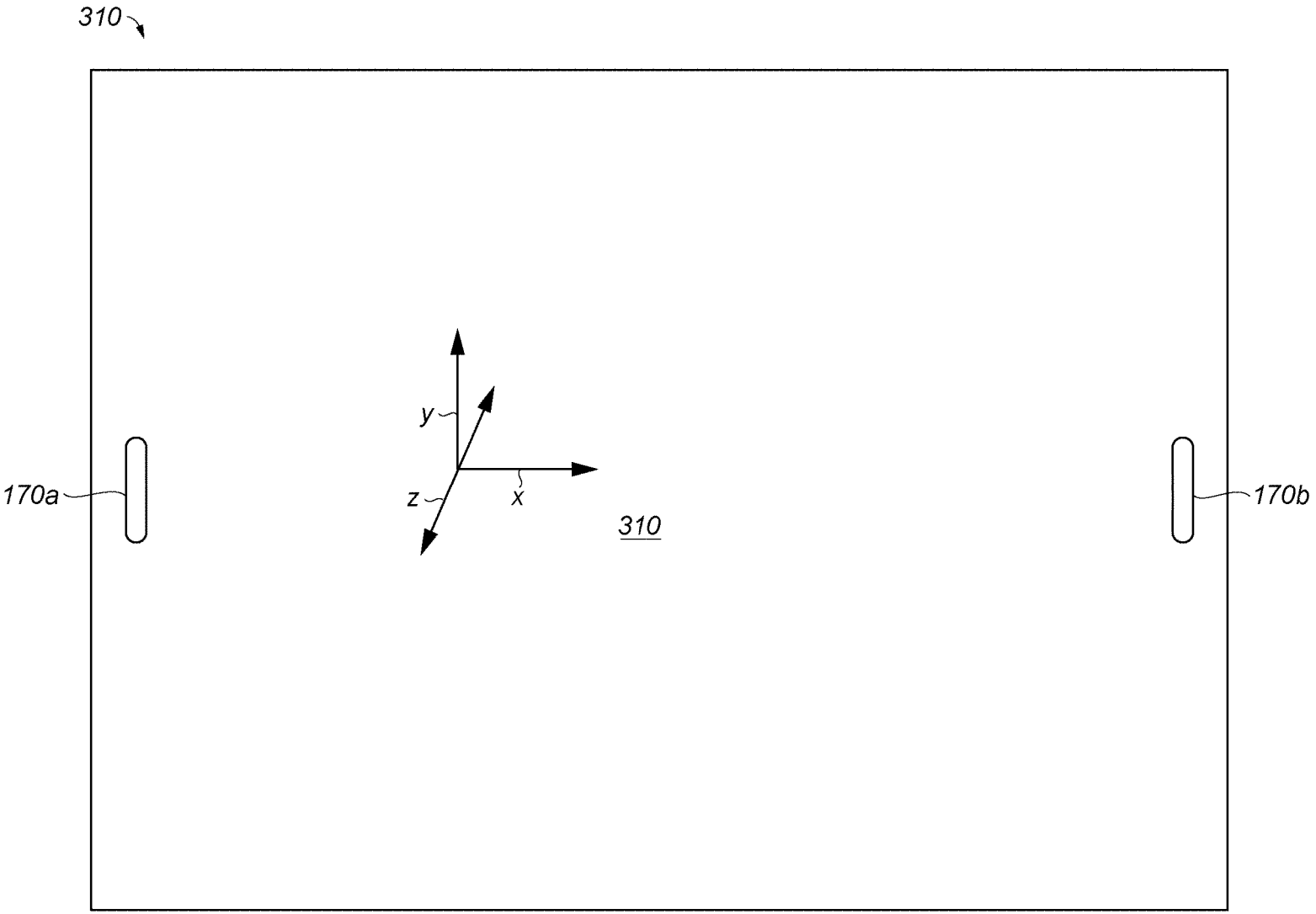

Also notice that the aperture 170*a*-170*b* enables a band 446 or strap 442 to be disposed inside of the outer perimeter of both the lower wall 110 (FIG. 2B) and the upper wall 310 as shown in FIGS. 3A-3B, so that the band 446 or strap 442 does not protrude and is not disposed outside of the outer perimeter of the lower wall 110 and upper wall 310, reducing a likelihood that such a band 446 or strap 442 could become entangled or "snagged" with some other object that is located outside of the constructed container 100.

FIG. 2C illustrates examples of various types of physical contact that can be made between side walls 212*a*-212*d* of the container 100. In accordance with the design of the invention, physical contact between the side walls 212*a*-212*d* does not require installation (employment) of penetrating fasteners, which are types of hardware, such as for example, nails, screws, staples or rivets. And further, some embodiments of the invention do not require installation of non-penetrating fasteners, such as clamps, clips or bracing. However, some embodiments of the invention do require banding, which is arguably a non-penetrating fastener. And preferably, physical contact between the side walls 212*a*-212*d* do not employ fastener types of hardware, nor application of an adhesive.

A penetrating type of fastener, is invasive to the container 110, and can be such as a nail, screw, staple or rivet, for example. A non-penetrating type of fastener can be such as application of an adhesive, and/or installation of a clamp, clip or brace, for example. Although an adhesive is a non-penetrating type of fastener, it can interfere with disassembly of the container 100, and as a result, is undesirable with respect to reuse of the container 110.

Within this figure (FIG. 2C), an enlarged illustration of a beveled edge type of physical contact 212, between the side walls 210*a*-210*d*, like that shown in FIG. 2B, is also shown here. Also shown in this figure, is an abutting type of physical contact 214, between the side walls 212*a*-212*d*. Also shown in this figure, is a notched type of physical contact 216, between the side walls 212*a*-212*d*. The notch type of physical contact 216, is generally preferred over the other types of physical contact between the side walls 212*a*-212*d* shown here. The invention does not restrict other types of physical contact between the side walls 212*a*-212*d* of the container 100.

Referring to FIG. 3A, the viewing perspective of FIG. 3A is in an opposite direction relative to that of the viewing perspective of FIG. 2B. The viewing perspective of FIG. 2B is directed downward (top-down) and towards the lower wall 110 and the side walls 212*a*-212*d* that are attached to the lower wall 110. Conversely, the viewing perspective of FIG. 3A is directed upward (bottom-up) and towards the downward facing surface of the upper wall 310. This viewing perspective is in a direction that is generally parallel to the Z axis.

FIGS. 3A-3B each illustrate different viewing perspectives of an upper wall 310 of the container of FIG. 1A.

FIG. 3A illustrates an upward directed view of an inside surface of the upper (top) wall 310 of the storage structure 110. As shown, in this embodiment, the structure of the downward facing inside surface of the upper wall 310 mirrors the structure of the upward facing inside surface of the lower wall 110 that is shown in FIG. 1B. This upper wall 310, like the lower wall 110, is rectangular and planar in shape, and has two broad (and) opposing sides. These two broad (and) opposing sides of the upper wall 310 include a downwards facing side (shown here) and an upwards facing side (not shown here), but shown in FIG. 3B.

Like the upward facing side of the lower wall 110, this downward facing side of the upper wall 310 includes a channel (groove) 320 that is cut into the downward facing side (outer surface) of the upper wall 310. This channel 320 is located a fixed distance from an outer perimeter of this downward facing side of the upper wall 310.

Like the lower wall 110, this channel 320 of the upper wall 310 forms a continuous perimeter of a shape, having the same shape and dimensions as that of the channel perimeter of the lower wall 110. This same shape is that of a rectangle having the same dimensions (shape and size) as that of the channel 120 of the lower wall 110. The channel 320 of this upper wall 310 is designed to receive an upper side edge of the side walls 210*a*-210*d*. Like that of the lower wall 110, the portion of this upper wall 310 that resides between the channel 320 and the outer perimeter of this upper wall 310, is referred to herein as a perimeter plateau 312, or as a margin 312, or as the outer margin 312 of the upper wall 310.

The channel 320 of the upper wall 310, and the channel 120 of the lower wall 110, are designed to mirror each other. Such mirroring means that an outer perimeter 322*a* of the channel 320 and an outer perimeter 122*a* of the channel 120 are same dimensioned (shaped and sized) and same located, and an inner perimeter 322*b* of the channel 320 and an inner perimeter 122*b* of the channel 120 are same dimensioned (shaped, sized, and same located so that when the side walls 212*a*-212*d* are inserted into both the channel of the lower wall 120 and the upper wall 320, the side walls 212*a*-212*d* are oriented perpendicular to each of the upper wall 210 and the lower wall 120, while the upper wall 320 and the lower wall 120 are oriented parallel to each other.

Individual straight-line segments of the outer perimeter 322*a* of the channel 320 form a shape that is a rectangle. Likewise, individual straight-line segments of the inner perimeter 322*b* also form a shape that is a rectangle.

A perpendicular closest distance, is a shortest length of a line that could be drawn between a point location along the outer perimeter 322*a* and a nearest point location along the inner perimeter 322*b*, and where such a shortest length of a line is perpendicular to both the outer perimeter 322*a* and the inner perimeter 322*b* when intersecting the two-point locations. This perpendicular shortest distance (shortest length) is designed to be uniform in length across the entire channel 320, and represents a uniform width of the channel 320. This uniform width of the channel 320 accommodates receiving an insertion of each of the side walls 210*a*-210*d*, each side wall 210*a*-210*d* having a thickness that is also uniform and dimensioned to fit into the individual line segments of the channel 320. This uniform width of straight-line segments applies to other embodiments of the invention, including the embodiments of FIGS. 6A, 6B, 6C, 6D, 6E, 6F, 6G, 6H, 6I, 6J (FIGS. 6A-6J).

Preferably, and in some embodiments, the width (thickness) of the channel 320 is dimensioned to be slightly more, such as 1/16 of an inch more, than the uniform thickness of each of the side walls 210*a*-210*d*, to accommodate insertion and a tight fit when inserting, each of the side walls 210*a*-210*d* into the channel 320. For example, in some embodiments, the width of each channel 120, 320 being equal to 16/32 of an inch, and the width (thickness) of each side wall 310*a*-210*d* being equal to 15/32 of an inch. The above-described design characteristic applies to other embodiments of the invention, including the channel 614 of the embodiments of FIGS. 6A-6J.

FIG. 3B illustrates a top-down view of the upper wall 310 as it is attached to the remainder of the container 100. Preferably, and as shown, the outer surface of the upward facing (exterior) side surface of the upper wall 310 has an even and level topology, and is absent of any channel or groove. The same is true for the outer surface of the downward facing (exterior) side of the lower wall 110 of FIGS. 1A-1C, 2A and 2B (2A-2B). Such an even and level outer (exterior) surface of the lower wall 110 and of the upper wall 310 accommodates stacking of multiple containers like the container 100 described herein, and accommodates sliding of this container 100 resulting from an intentional pushing force provided by warehouse personnel along a surface of a floor or along an exterior surface of another container 100, like that described herein.

Also, the perimeter of the lower wall 110 and of the upper wall 310 forms a rectangular shape having four (4) straight edges sides. These straight edged perimeter sides facilitates tight side to side lateral packing of a plurality of these designed containers into a matrix, such as into a 4×3 matrix, being 4 rows of 3 containers that are packed side by side, for example. These same stacking, packing and sliding features of the container 100, are also provided by other embodiments of the invention, such as for example, by provided by the container 600 that is described in FIGS. 6A-6J.

Figure 6A:
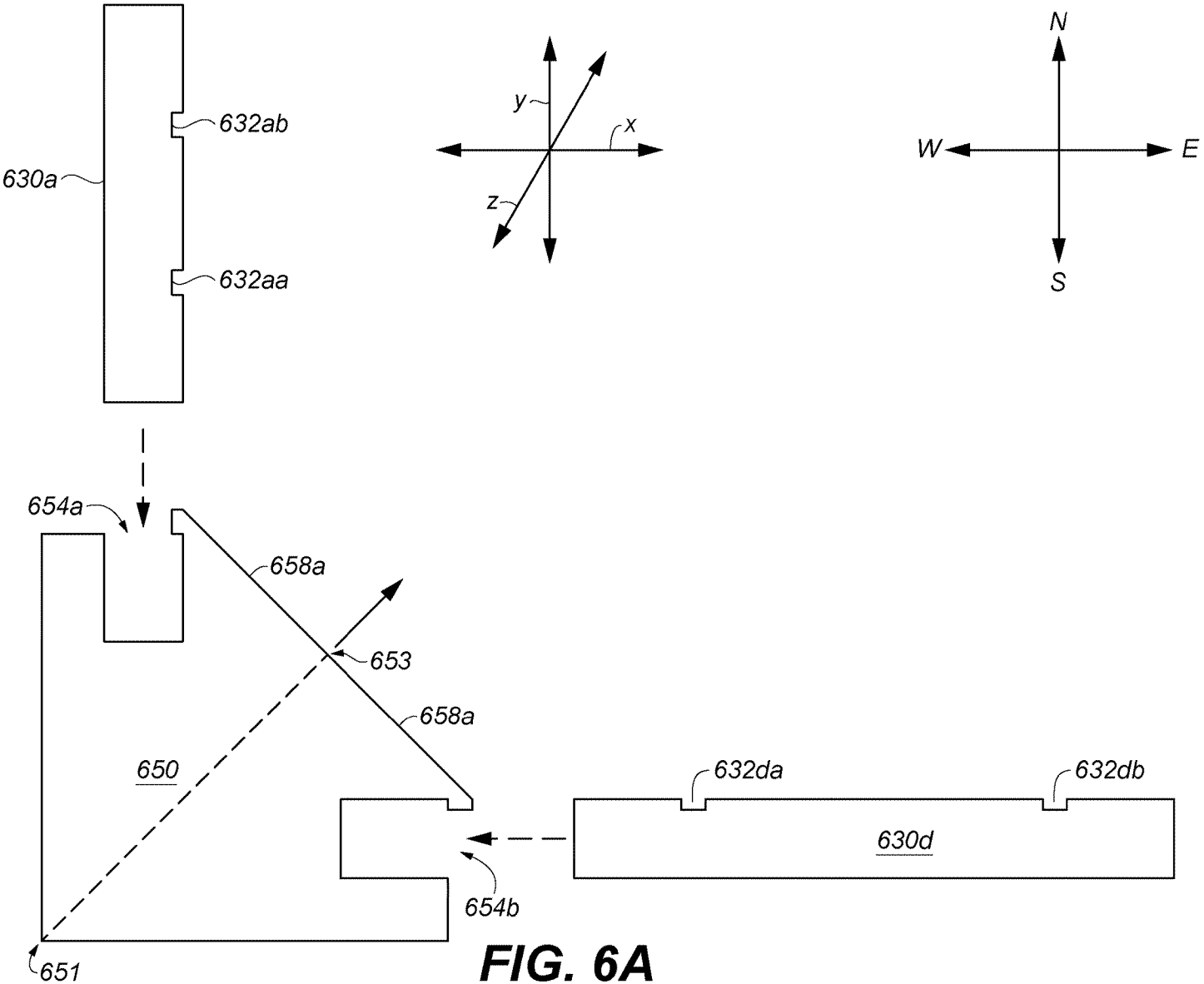
FIGS. 6A, 6B, 6C, 6D, 6E, 6F, 6G, 6H, 6I, 6J (FIGS. 6A-6J) collectively illustrate various viewing perspectives of a corner component of a container and its incorporation into a container.
Figure 6B:
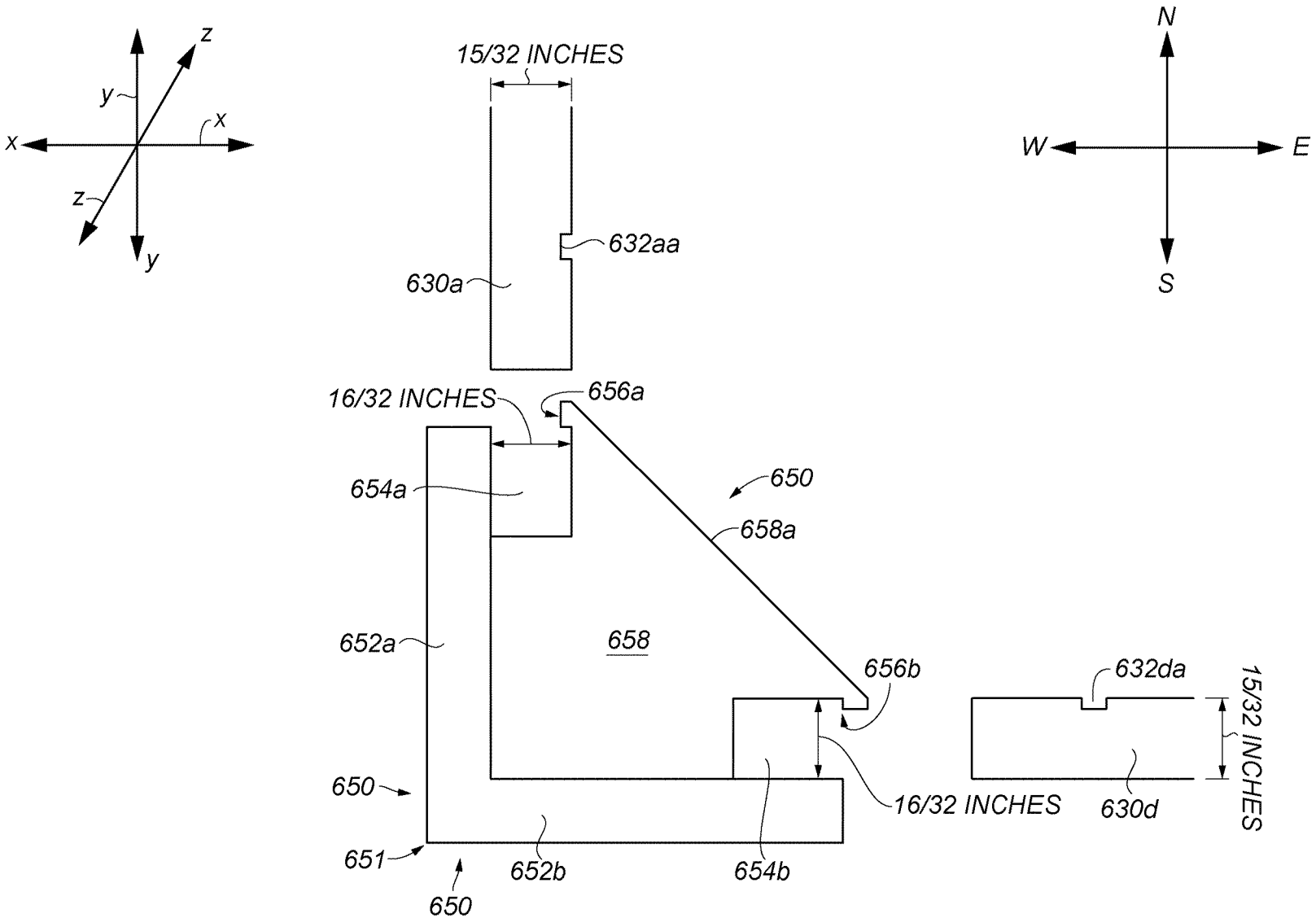
Figure 6C:
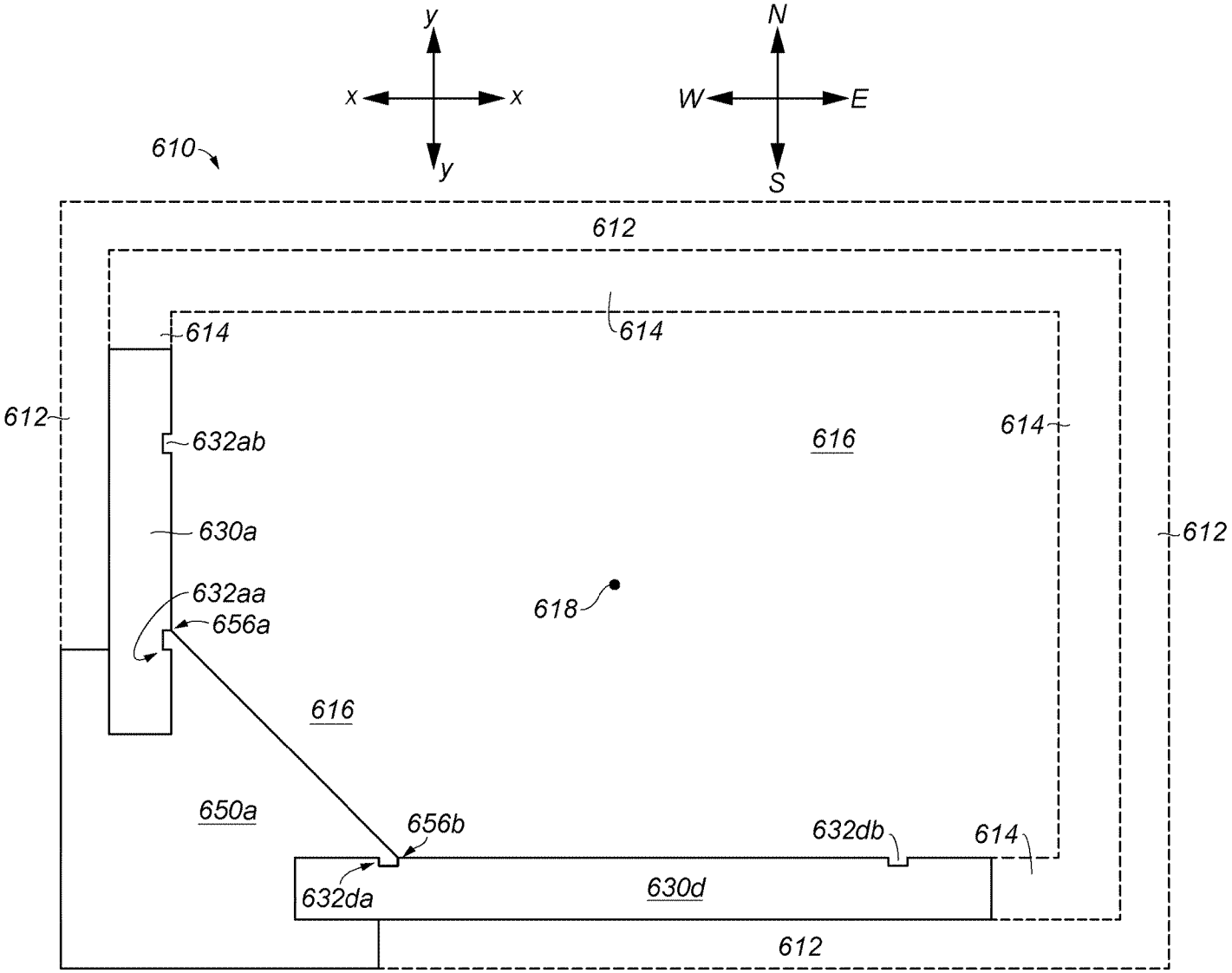
Figure 6D:
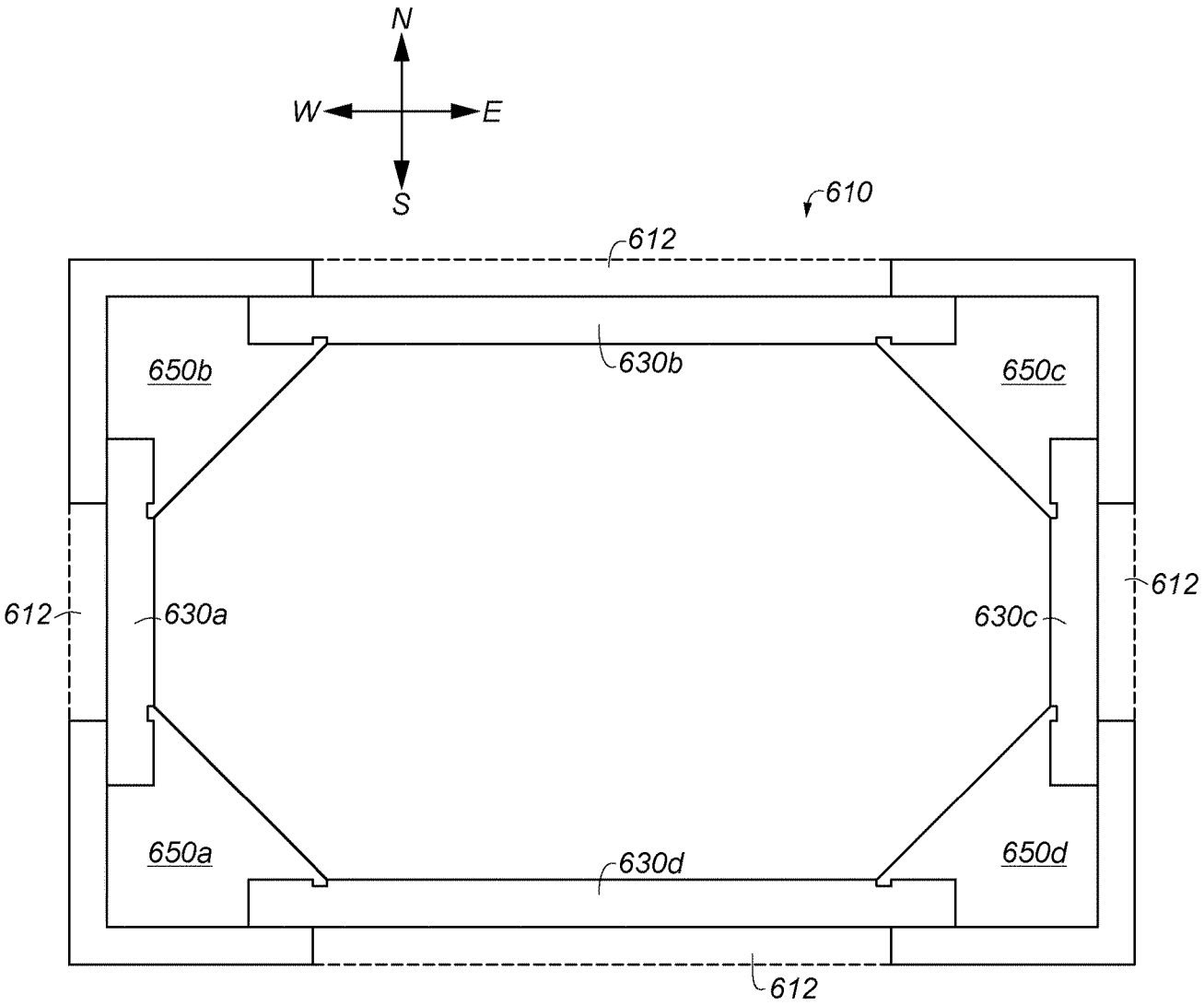
Figure 6E:
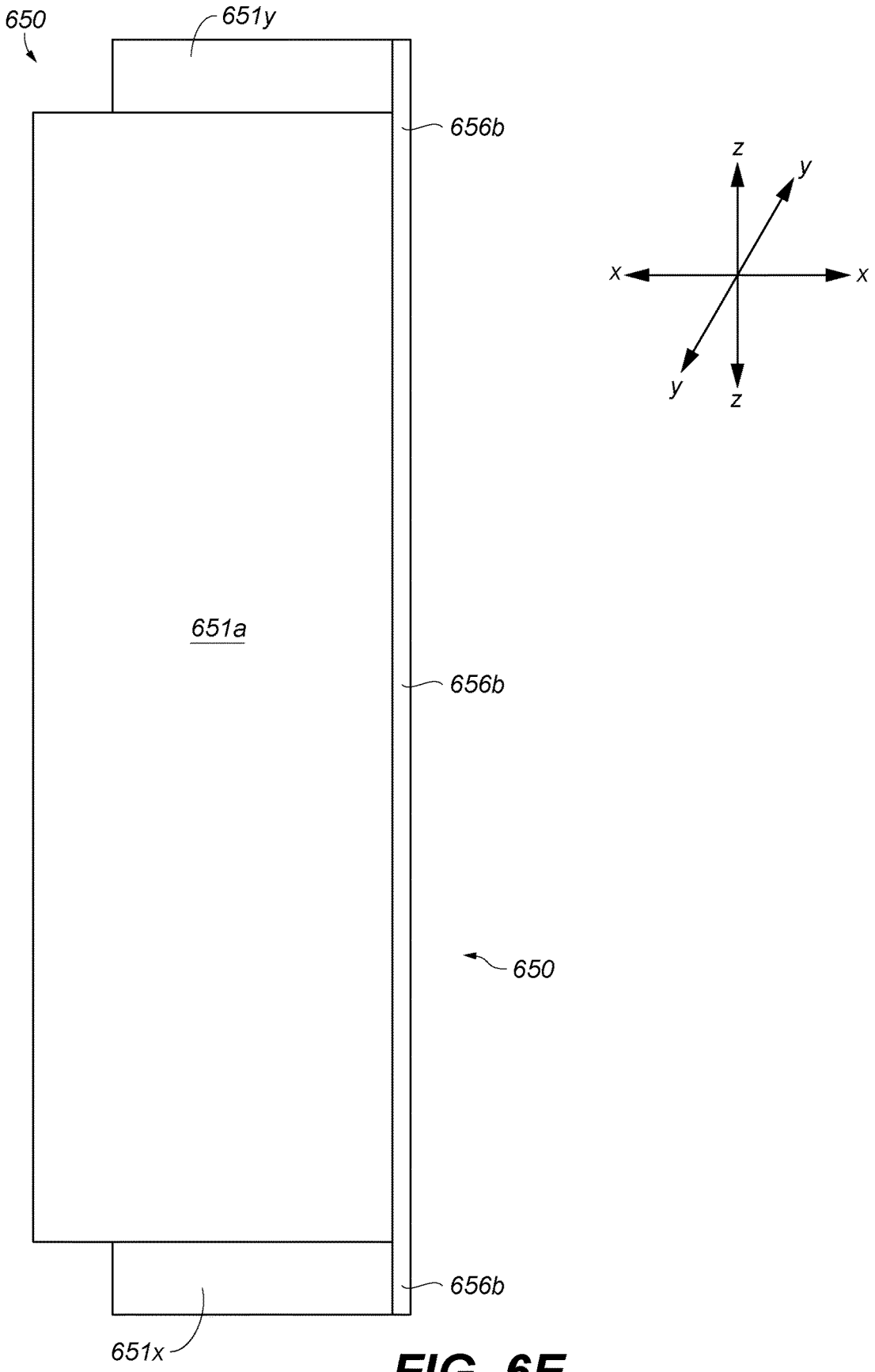
Figure 6F:
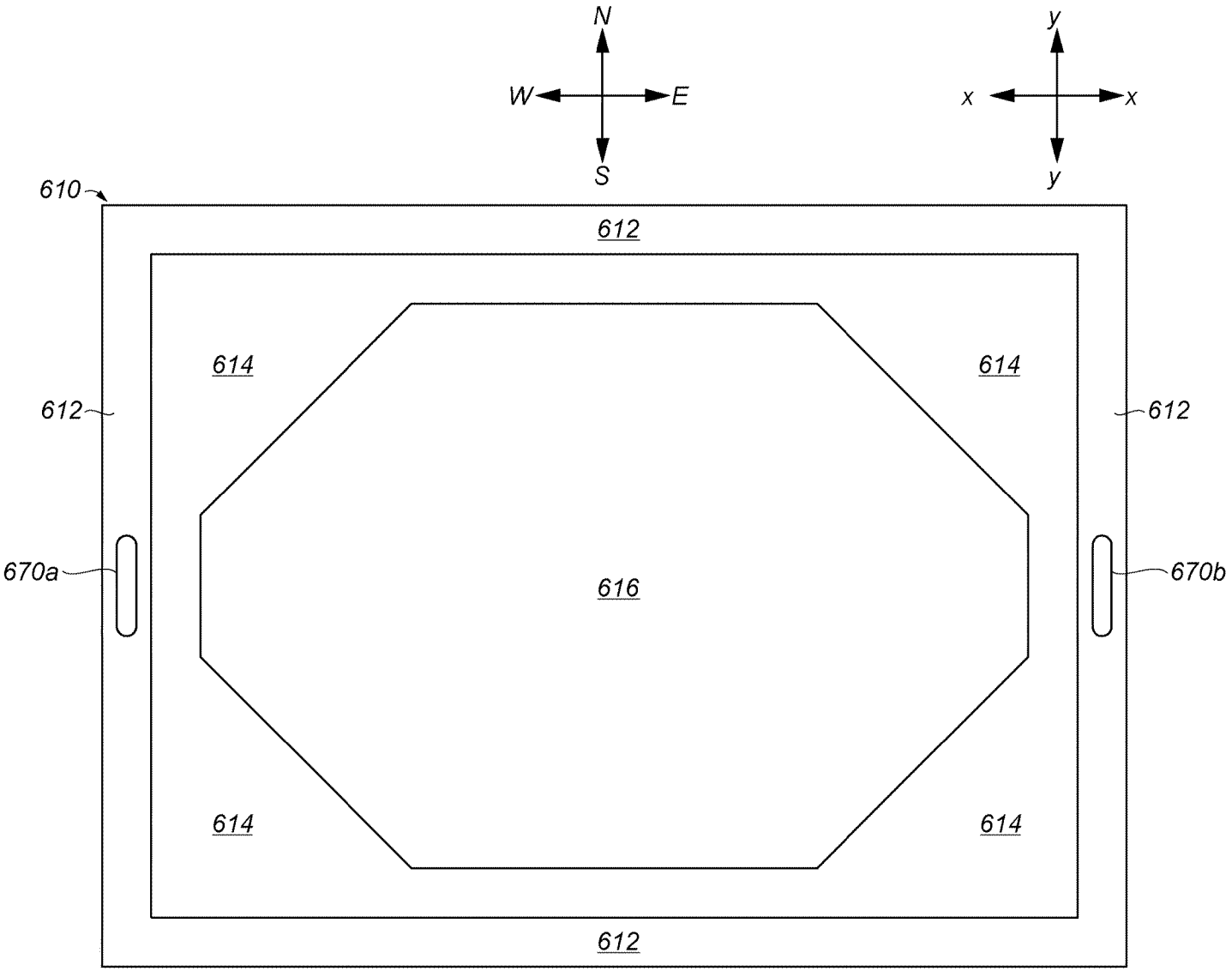
Figure 6G:
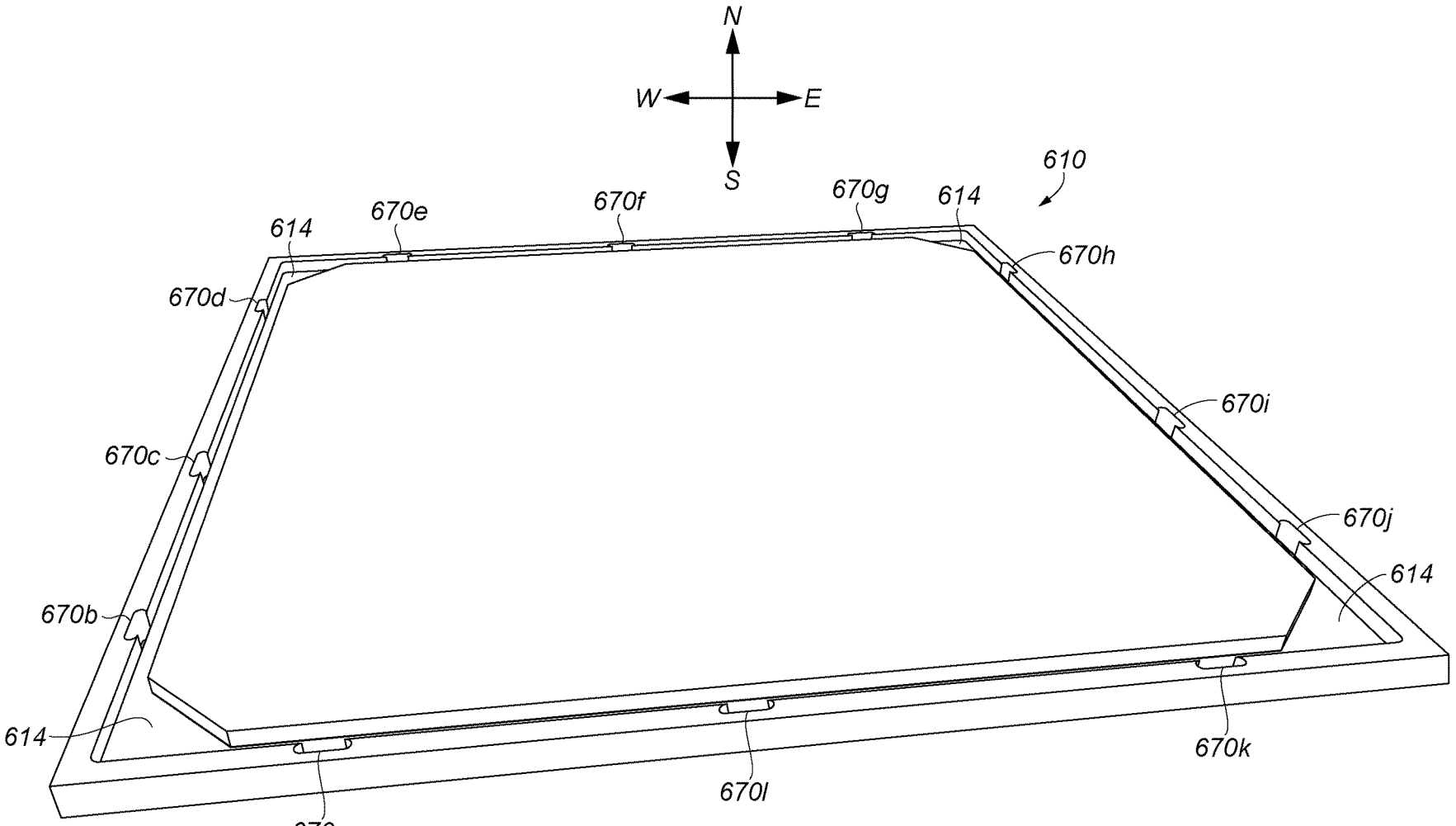
Figure 6H:
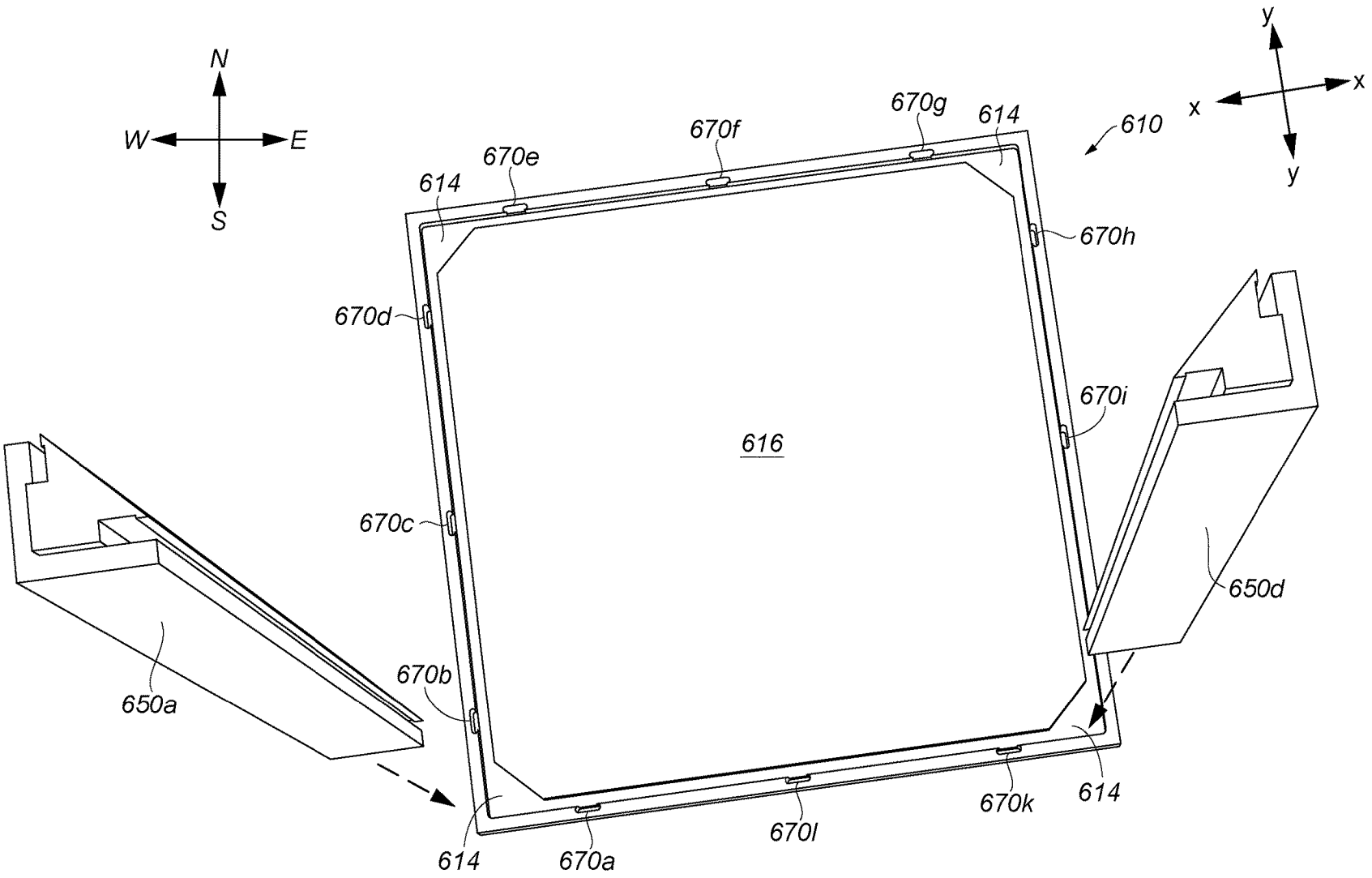
Figure 6I:
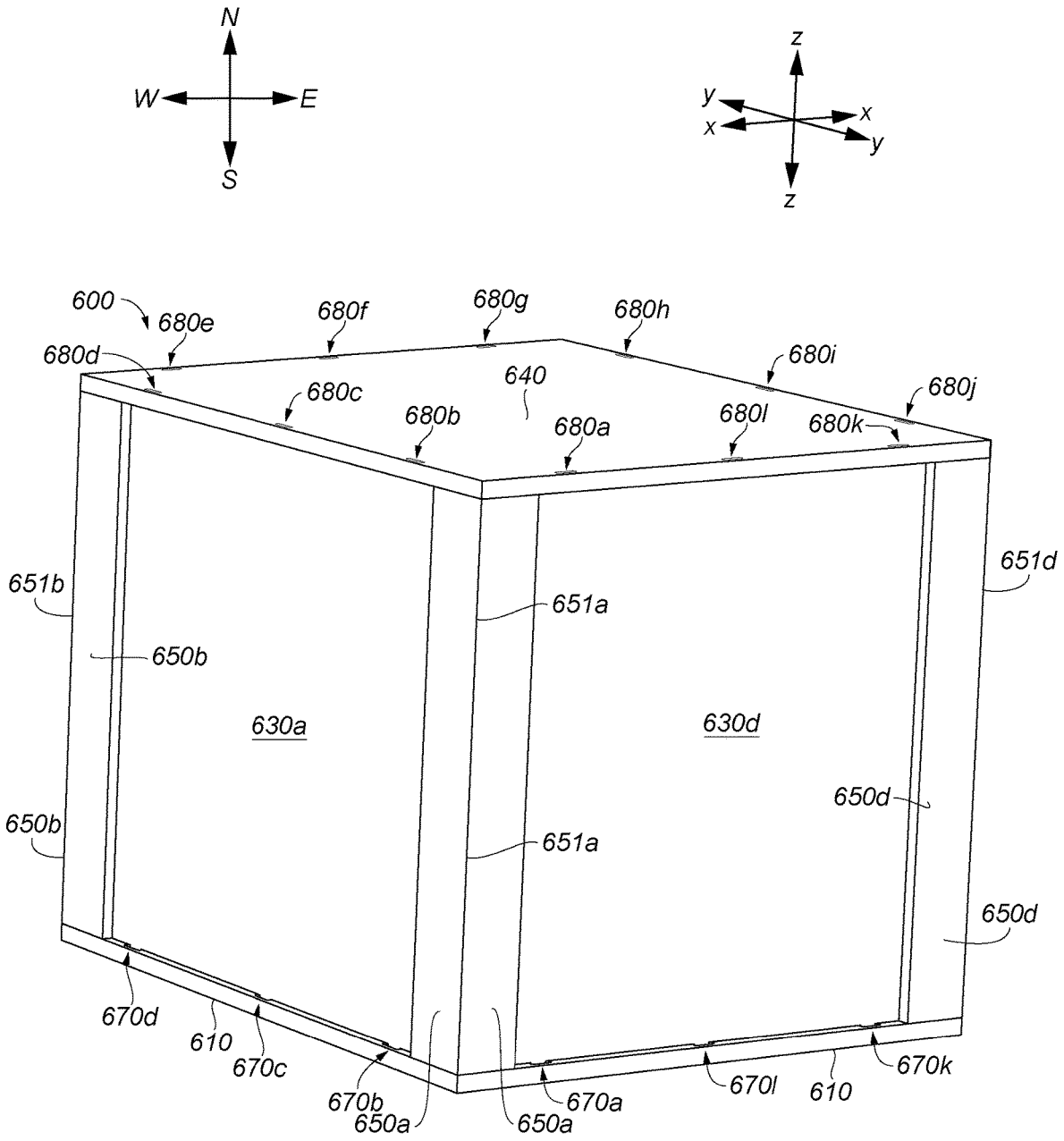
Figure 6J:
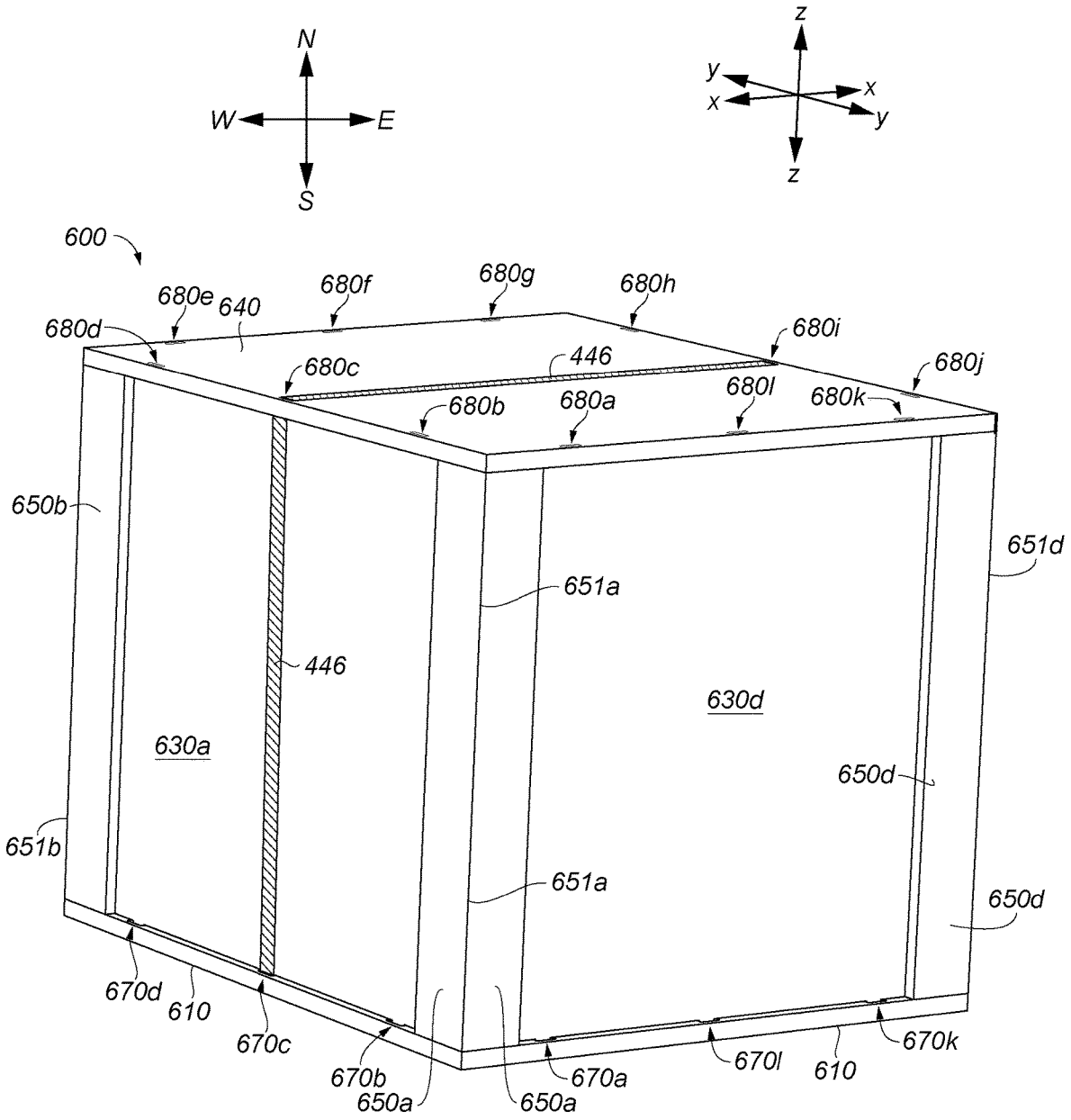

The container 100 and the container 600 shown in FIGS. 61 and 6J, and their respective container components that are incorporated into each container 110, 610, can be made from a variety of types of material, such as for example, from various types of wood (particle board (OSB), plywood, pine, Douglas fir, spruce, oak for example), plastic or metal, or from a composite type of material, for example. Preferably, the material having characteristics that enable it to be accurately cut, shaped and routed by computer numerically controlled (CNC) machines. And preferably material that can be recycled.

In one embodiment, the container 100 can be made from 15/32 inch thick plywood, sometimes and nominally referred to as "one-half inch thick plywood", where the lower wall 110, upper wall 310 and side walls 210*a*-210*d* are each cut from such one-half inch thick plywood. Typically, the channels 120, 320 are each cut at least one quarter inch deep into both the lower wall 110 and the upper wall 310, respectively. The uniform width of each channel 120, 320 being 16/32 inches wide and at least 1/32 of an inch wider than the 15/32 inch wide uniform width of each of the side walls 210*a*-210*d*. The dimensions of the outer perimeter of the lower wall 110 and of the upper wall being 16 inches by 12 inches, just for example. The margin between the outer perimeter of the channels 120, 320 and the outer perimeter of the lower wall 110 and of the upper wall 310, being equal to approximately one-half inch, for example.

The above-described embodiment can be modified in a myriad of ways. The above embodiment can be made from particle board, referred to as OSB, instead of from plywood. Or can be made from a polymer (plastic) type of material. Alternatively, the side walls 210*a*-210*d* can be thinner and have a shorter uniform thickness, for example, where these side walls 210*a*-210*d* are instead 3/8 of an inch thick, and the channels 120, 320 are 7/16 of an inch in width, to accommodate a tight insertion the thinner side walls 210*a*-210*d*.

The material and dimensions of a particular container 100 and 600 depend upon the type and amount of content the container is to contain (store and enclose). For example, heavier content requires stronger walls and/or stronger corner components to surround and to physically support such heavier content. The distribution and direction of the weight of the content needs to be anticipated so as to know what material and what proper thickness of the side walls 210, 630 and that of the lower wall 110, 610 should be, so as to sufficiently support such distribution and direction of weight, for when the container 100, 600 is stationary and for when the container 100, 600 is disposed upon a pallet and being accelerated and decelerated during its transport, via truck, train, ship and/or airplane.

FIGS. 4A, 4B, 4C and 4D (FIGS. 4A-4D) illustrates use of one or more of a band or strap to seal a constructed container of FIG. 1A.

Figure 4A:
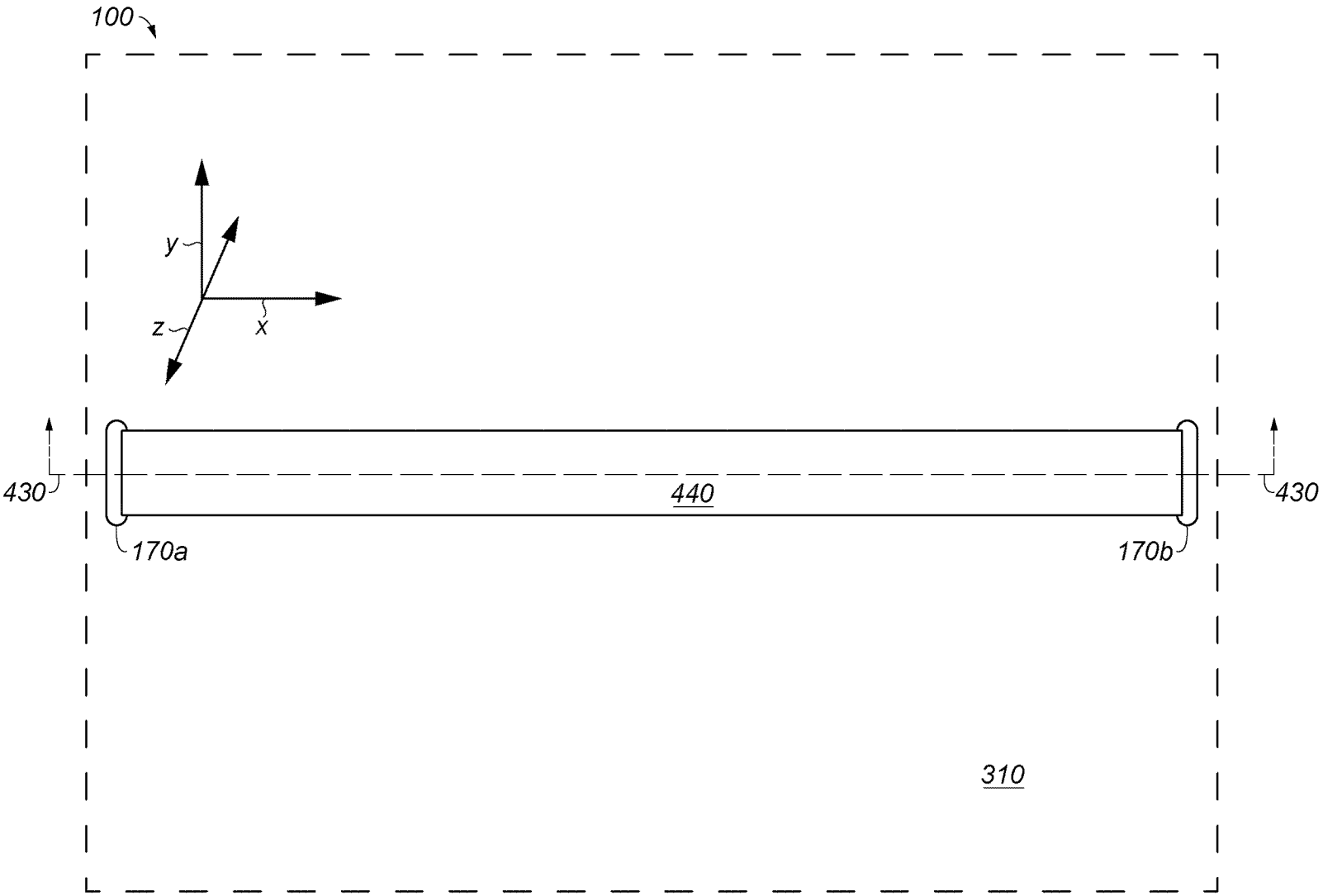
FIGS. 4A, 4B, 4C, 4D and 4E (FIGS. 4A-4E) illustrates use of one or more bands to seal a constructed container of FIG. 1A.

FIG. 4A illustrates a top-down viewing perspective of a band 440, also referred to herein as a strap 440, that forms a continuous loop that spans (straddles) across the exterior surface of the upper wall 310, the exterior surface of the side walls 210*a* and 210*c* and the exterior surface lower wall 110, to wrap around and surround the container of FIG. 1A.

A tensile force is applied to the band 440 as it surrounds the container 100, causing the band to apply a tensile (constricting/pressing/squeezing) force upon the container 100. This tensile force causes portions of the container 100, to press against each other, to better seal any content that is stored within the container 100. Essentially, the components of the container 110, such as the lower wall 110, upper wall 310 and side walls 210*a*-210*d*, are designed to connect and bond with each other to form an assembled (constructed) container 110. The additional force applied by the band 440 or strap 440 to the container 110, increases the bonding (joining) force, being a pressing (joining) force between adjacent components of the container 110, to strengthen the structure of the assembled (constructed) container 110.

The band or strap 440 is preferably made from a polymer-based material, also referred to herein as a plastic or rubber-based material. The band 440 can be made from other materials including metal, cloth, leather, nylon etc. Preferably, this strap 440 or band 440 is configured to withstand and maintain a tensile (constricting) force of at least 200 pounds or greater while being applied to the container 100, without further stretching or breaking. An actual tensile force applied by the band 440 to the container can be varied below or above this 200-pound tensile force and can vary based upon the circumstances of how the container is intended to be employed (used). A band 440 is typically 1 to 2.5 inches in width, but such a band 440 can be dimensioned outside of this range, and customized based upon how a container is expected to be employed (used).

Figure 4B:
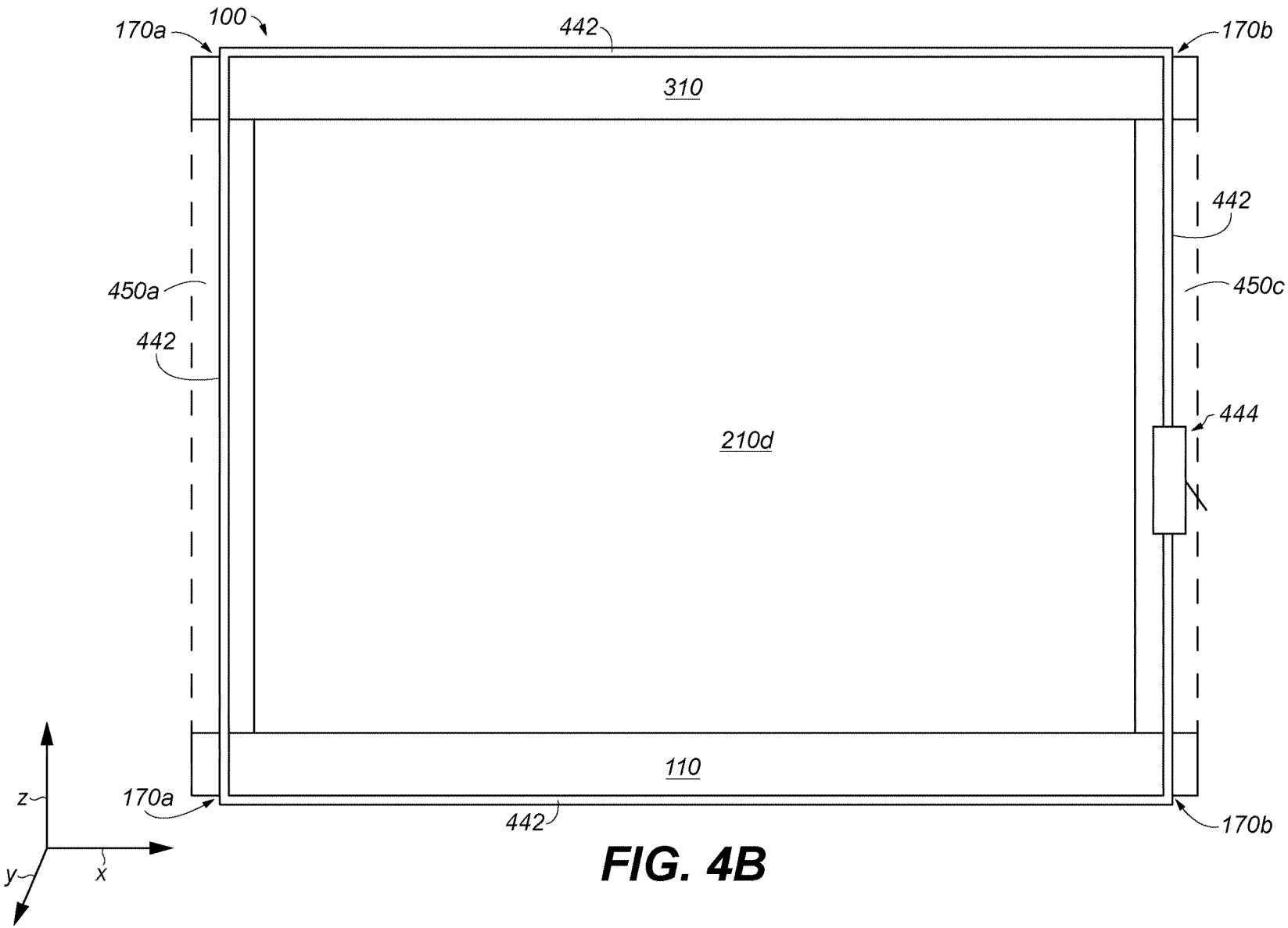

FIG. 4A further includes a horizontal dashed line 430 that indicates a cross-sectional and horizontal viewing perspective of the container 100, and of the band 440 as it is wrapped around the container 100 of FIG. 4A. The container of FIG. 4A is standing upright relative to the surface of the earth and relative to the direction of gravity. This cross-sectional and horizontal viewing perspective is shown in FIG. 4B. This cross-sectional and horizontal viewing perspective is directed substantially parallel along the Y axis, and parallel to the surface of the earth, as shown here. The Z axis, which is perpendicular to the Y axis, is directed parallel to the direction of gravity, as shown here.

This band 440 is referred to herein as being vertically oriented, because when the band 440 is wrapped around the container as shown here, it forms a loop that is substantially oriented along (parallel to) a plane that is defined to be parallel to the X and Z axes, as shown here. This plane also intersects and is oriented perpendicular to the surface of the earth.

FIG. 4B illustrates a cross-sectional and horizontal view of the container 100 of FIG. 4A, this view being indicated by the horizontal dashed line 430 of FIG. 4A. In this circumstance, the band 440 is implemented as a ratchet strap 442. A ratchet portion 444 of the ratchet strap 442 is configured to apply a tensile (pulling) force to the strap portion of the ratchet strap 442, as it surrounds the container 100. In some embodiments, the ratchet strap 442 is designed to incorporate a lock, or locking mechanism, to provide further security towards protecting the content while sealing of the container 100, via the strap 442.

The tensile force that is applied to the ratchet strap 442 applies a constricting (pressing/squeezing) force to the container 100. As shown here, the tensile (squeezing) force when applied to the container 100, essentially pulls the lower wall 110 and the upper wall 310 towards each other, to press against each other, and also pulls and presses the side walls 210*a*-210*d* into both the lower wall 110 and into the upper wall 310. As a result, this tensile force that is applied by the band 442 strengthens a force of bonding, at locations of physical contact, between the lower wall 110 and the side walls 210*a*-210*d*, and strengthens a bonding, at locations of physical contact, between the side walls 210*a*-210*d* and the upper wall 310 of the container 100. The lower wall 110, side walls 210*a*-210*d* and the upper wall 310 being components, and not fasteners, of the assembled (constructed) container 100.

Such strengthening of the forces of bonding caused by applying the tensile force to the container 100 via a band 440, regardless of whether the band 440 is a ratchet strap 442 or another type of band 440, can circumvent a need to employ traditional fasteners or adhesives to strengthen a bonding between various portions of the container 100. Adjacent the side walls 210*a*-210*d*, being pressed into the channels of the lower and upper walls, can circumvent a need to employ traditional fasteners between each of the side walls 210*a*-210*d*, and between the side walls 210*a*-210*d* and the lower wall 110 and/or the upper wall 310. Such traditional fasteners being hardware including penetrating or non-penetrating types of fasteners.

Furthermore, traditional fasteners often require penetration of the material from which the container 100 is made. For example, staples, rivets, nails and screws, which penetrate material from which the container 100 is made, can be employed to strengthen a bonding between portions of the storage structure 100. A traditional fastener typically requires a minimum required depth of material at a location where the fastener penetrates a portion of the container 100.

This minimum depth of material required for a penetrating fastener, may exceed a depth of the material at a location where the penetrating fastener is intended to penetrate the container 100, such a location being within a side wall 210*a*-210*d* of the container, for example. In this circumstance, a side wall needs to be strengthened with additional material to increase a depth of material to accommodate penetration of a screw or nail, at such a particular location within the container 100. This circumstance causing additional material to be required to exist within, or to be added to, the container 100.

Furthermore, use of traditional fasteners typically require workers to spend more labor and time to make use of fasteners while constructing a container. Such use of fasteners creates a risk of error and/or injury to workers during the construction of a container. This can especially be true when workers are required for installing one or more penetrating fasteners, such as a staples, screws and/or nails, into a container, for example.

The design of the embodiments of the invention that are described herein, do not require installation penetrating fasteners. This design avoids use of such penetrating fasteners, but however, this design does not prevent use of such penetrating fasteners. Use of such penetrating fasteners can interfere with the realization of the desired benefits (goals and objectives) of the invention, as described herein with respect to recyclability and reusability of the container 100, 600, and as a result, installation of such penetrating fasteners is not required, and not preferred to be incorporated into the herein described container embodiments of the invention 100, 600. While one band is shown in FIGS. 4A, 4B, 4C and 6J, additional bands or straps 440, 442, 446 may be installed as desired around the lower 110, 610, upper walls 310, 640 and side walls 210, 630 of each respective container 110, 610.

Figure 4C:
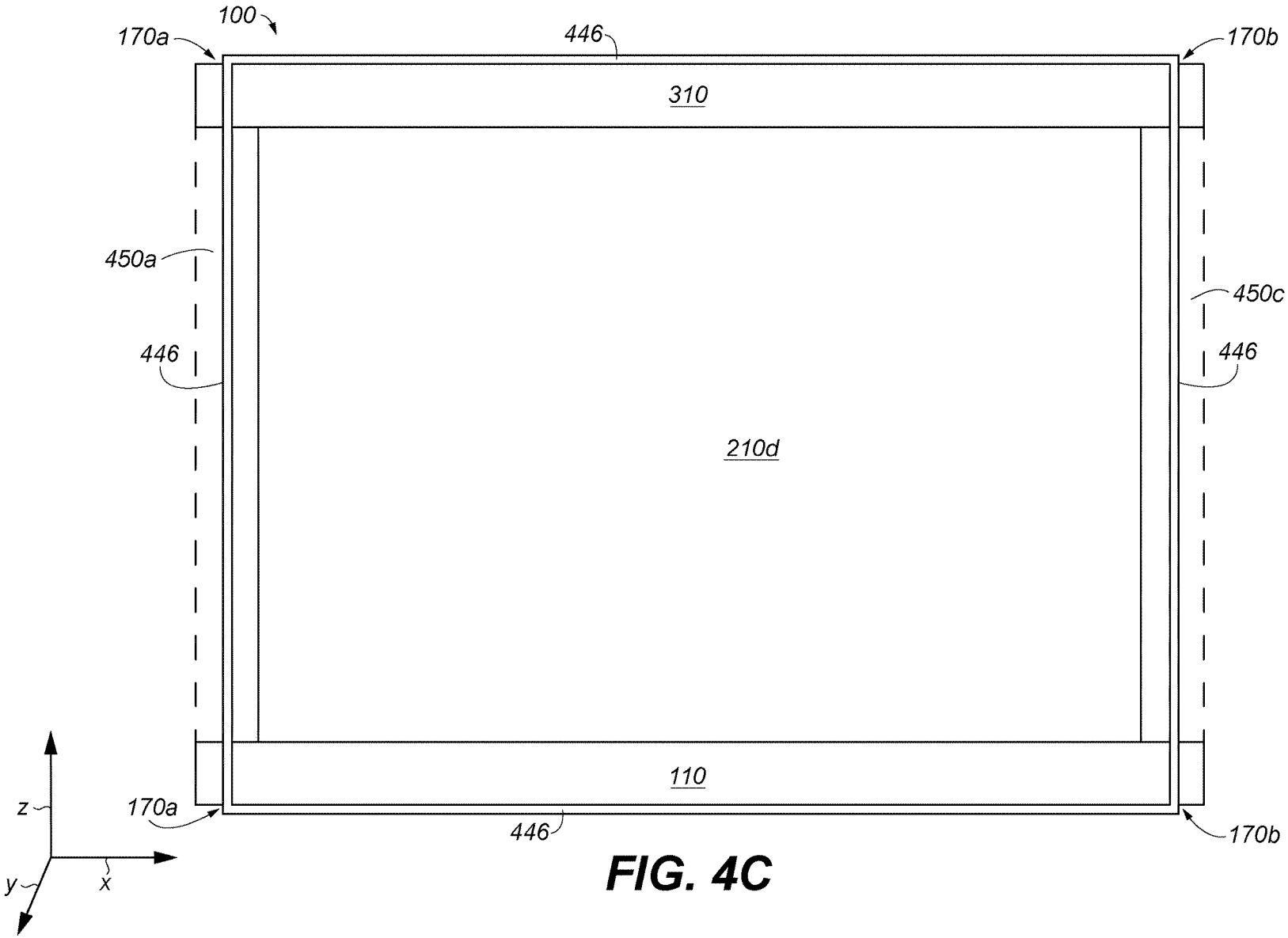

FIG. 4C illustrates a cross-sectional view of another embodiment of the band 440 of FIG. 4A that is surrounding the container of FIGS. 4B-4C. In this embodiment, the band 440 is implemented as a heat bonded band 446, and not implemented as a ratchet strap 442. A specialized device, such as a battery powered Fromm Plastic Strapping device, Model P328S for example, is designed to apply both a tensile force to the band 446 and designed to apply heat to an overlapping region of two ends of material that will form a joined band via a melting together of the two ends of the overlapping region, followed by cooling and solidification of the joined band. The heat bonding of the heat bonded band 446 is performed while the heat bonded band 446 it is wrapped around the container 100, in order to bond the heat bonded band 446 in a loop formation while it (the band 446) is wrapped around and surrounding the container 100, and while the band 446 remains under tension.

An advantage of this type of heat bonded band 446 is that this type of band 446 is more tamper resistant than a ratchet strap 442 of FIG. 4B. In other words, this type of band 446 is required to be severed (cut) to terminate the application of the tensile force from the band 446, surrounding to the container 100, in order to obtain access to the content of the container 100. However, the cutting of the band 446 provides evidence of someone possibly having accessed the content of the container 100, and possibly having tampered with the container 100, and possibly tampered with the contents of the container 100. Upon cutting the heat bonded band 446, the container 100 becomes unsealed, and it is difficult for someone to re-seal the container 100 and difficult for someone to hide the evidence of cutting the heat bonded band 446 and hiding prior tampering of the container 100.

From the viewing perspective of this figure (FIG. 4C), notice that the lower wall 110 and the upper wall 310 each extend laterally (cantilever) beyond the side walls of the container 100 in both opposite directions along both the X and Y axes. This creates open volume of space 450*a*, 450*c* located outside of and around the container 100 through which a heat bonded band 446, or another type of constricting fastener, such as a ratchet strap 442 for example, can pass through this open volume of space 450*a*, 450*c*, so as to reduce a risk of the heat bonded band 446 or ratchet strap 442 colliding with a wall or other object, or colliding with a side wall of another same designed container 100.

Also, this lateral extension (cantilever) of the lower wall 110 and of the upper wall 310, creates a "bumper" effect, in that it prevents the side walls of the container 100 from colliding with side walls of other same designed containers 100 that are disposed (placed) laterally next to each other onto a floor or onto a large pallet. Also, notice that both the lower wall 110 and upper wall 310, each have external surfaces that are parallel with respect to each other, and further, having a flat and even surface topology, so as to facilitate convenient vertical stacking of this type container 100 as it is designed. Theses above-described features are also provided by other embodiments of this invention, including such as for example, the container 600, that is described in FIGS. 6A-6J.

Figure 4D:
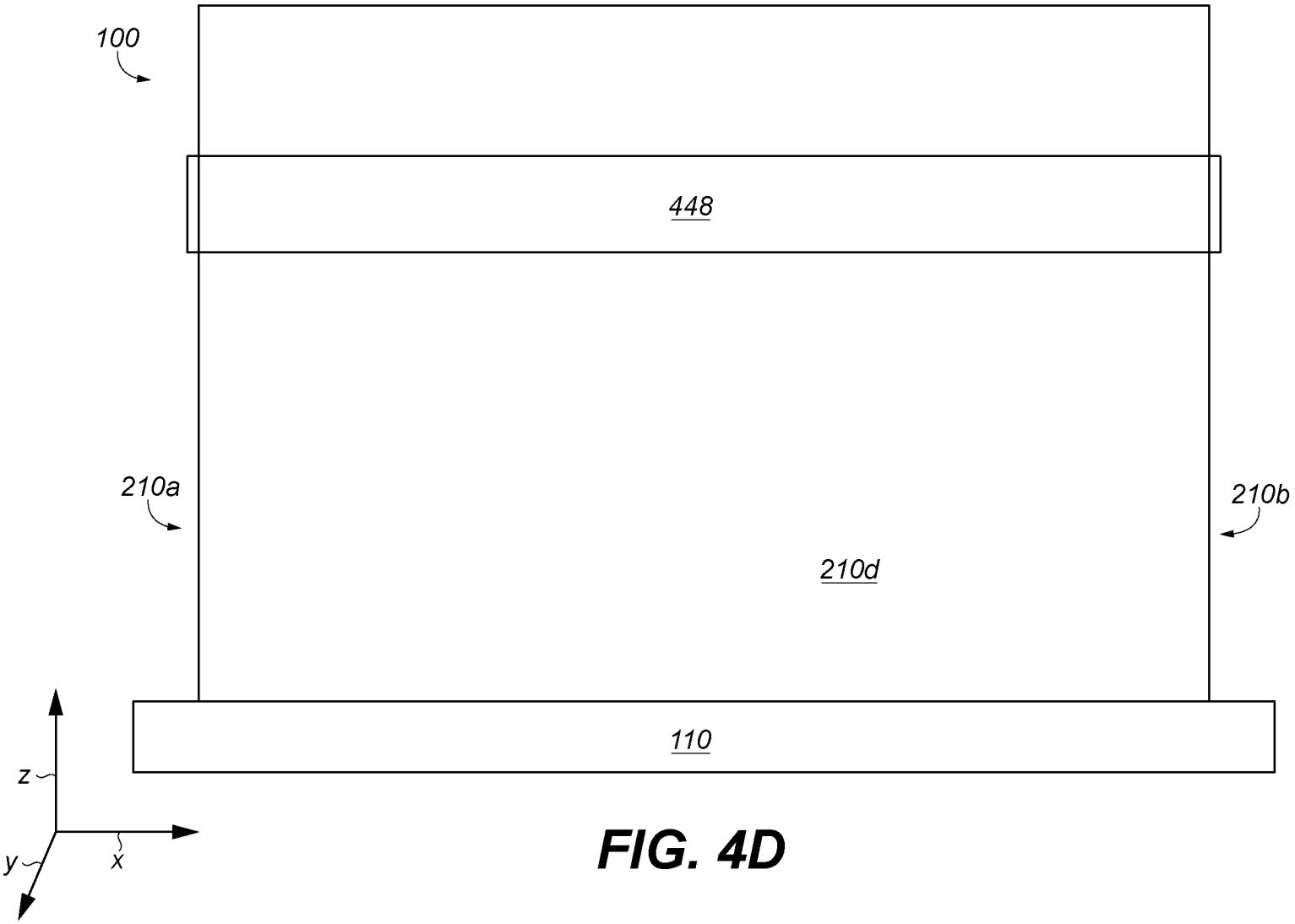

FIG. 4D illustrates a horizontal (side) viewing perspective of a partially constructed container 100. The partially constructed container 100 is a container 100 that lacks an attached upper wall 310, but however, also has a band 448 wrapped horizontally around its side walls 210*a*-210*d*, to strengthen a bonding between the side walls 210*a*-210*d* of the fully assembled container, without the upper wall 310 being attached to the container 110, causing those side walls 210*a*-210*d* to be un-attached to an upper wall 310 of the container 100, in circumstances such as when loading content for storage into the container 100. The band 448 can be formed like that of a heat bonded band 446, or be installed as a ratchet strap 442.

In this circumstance, content that is being stored into the enclosed space of the container can stack, pile and/or lean against one or more side walls 210*a*-210*d*, causing a pushing force upon those side walls 210*a*-210*d* that is directed outward and away from the enclosed space and away from the leaning content that is being placed/stored within the enclosed space of the container 100.

For example, if someone were loading a pile of rocks into the container 100, such heavy and loose content would stack and/or pile and likely push the side walls 210*a*-210*d* and cause the side walls 210*a*-210*d* to bow away from the enclosed space and away from the content being stored within the enclosed space of the container 110. To counteract this risk of deforming the container 100, the band 448 is wrapped horizontally around the container 110, as shown in this FIG. 4D. This horizontally oriented band 448 is designed to constrict (pull) the walls 210*a*-210*d* towards each other, and to press these walls against each other, via the tensile force applied by the band 448, in order to create an additional bonding (joining) force between these walls and to hold these walls 210*a*-210*d* in a vertical and upright position, while content is leaning and pressing outwards against the walls 210*a*-210*d* of the container.

This band 448 is referred to herein as being horizontally oriented, meaning when the band 448 is wrapped around the container as shown here and in FIG. 4D, it forms a loop along a plane that is substantially parallel to a plane that is defined by the X and Y axes, and where this defined plane is oriented parallel to the surface of the earth, and perpendicular to the direction of gravity.

Upon filling the container 100 with content, the upper wall 310 can be attached to the side walls 210*a*-210*d*, to provide a further bonding force from the upper wall 310 to each of the side walls 210*a*-210*d*, and a bonding force between the side walls 210*a*-210*d*, in addition to that provided by the horizontal oriented band 448. Optionally, the horizontal oriented band 448 can be removed from the container 100, prior to transporting the container to another location, or the horizontal oriented band can remain wrapped around the container 100 indefinitely.

A vertically oriented band 440, like that shown in FIGS. 4A and 4B or 4C, is preferably wrapped around the container 100 including an attached upper wall 310, and a tension applied to the vertically oriented band to further seal the container 100, prior to transporting the container, if applicable, to another location.

Figure 4E:
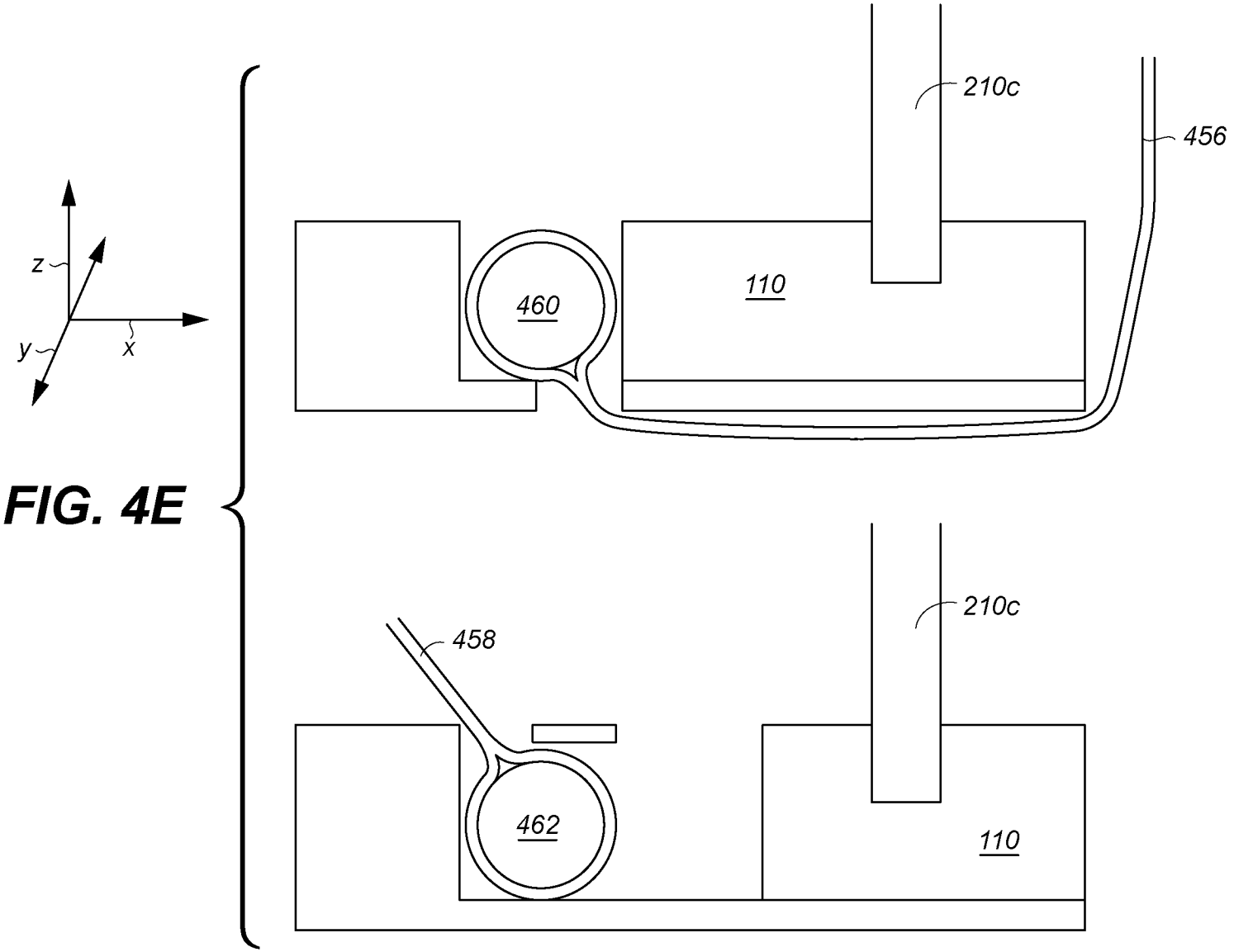

FIG. 4E illustrates a side (horizontal) cross-sectional view of an external band anchor 460 and an internal band anchor 462. Both external band anchor 460 and internal 462 band anchor are embedded into the lower wall 110 of the structure of the container 100. This cross-sectional viewing perspective is like that shown in FIG. 2A.

As shown, the external band anchor 460 is cylinder shaped object and attached to a section of band 456 (or ratchet strap 442) that protrudes externally from a lower wall 110 of a container 100, and where the band 456 that is configured be bonded within another section of band (not shown here). After bonding (heat binding or ratcheting) with the other section of band to form a combined band, the combined band applies a tensile force straddling the upper wall (not shown here), and surrounding the upper wall and side walls, and the outer edges of the lower wall 110 of the container 100, having a same squeezing (sealing) effect to the container 100, as that of that tensile force applied by the band 446 to the container 100 of FIG. 4C. Notice that the rachet strap 442 and band 446 each make physical contact with lower wall 110 and the upper wall 310, but the rachet 442 strap and band 446 does not make physical contact with any side wall 210*a*-210*d* of the container 100.

The band anchor 460, is also referred to and classified as an external band anchor, because the section of band 456 being anchored by the external band anchor 460, is protruding externally from the container 100. This protruding section (portion) of band 456 is dimensioned (sized and shaped) so that it can make physical contact with, and overlap with, and be bonded (heat bonded or ratcheted) with another section of band (not shown here), to form a combined band that surrounds the container 100. The other (another) section of band is likewise anchored by another band anchor (not shown here) that is embedded at another location within the lower wall 110, and where the other location is proximate to another side wall 210*a*, that is located on an opposite side of the container 100, and having a broad side that is oriented parallel to the broad side of the side wall being shown here 210*c*.

The band anchor 460, being an optional (non-required) component within the container 100, is preferably made from a rigid and strong material, and optionally made from a metallic material, such as steel, for example. In some embodiments the band anchor which is shaped as a cylinder, is ⅜ inches in diameter and 3 inches in length. The length of the cylinder shape of the band anchor 460 being greater than a width of a band for which it is attached.

In another embodiment of a band anchor 462, and as also shown in this figure, an internal band anchor 462 is attached to a section of band 458 that is configured be bonded within another section of band, to form a combined band (not shown here). The combined band, after bonding, straddles an object being stored as content inside of the container 100, and applies a tensile force that presses the object against the lower wall 110 of the container 100, to arrest movement of, and to secure the object as content being stored inside of the container 100.

The band anchor 462 shown in this figure, also referred to herein as a first band anchor 462, is also referred to and classified as an internal band anchor 462, because the section of band 458 being anchored by the internal band anchor 462, is protruding inside of (internally within) the container 100. Typically, a band or strap that is attached to each of two separate internal band anchors 462, are joined (overlapped) and tightened via a rachet device to press an object being stored as content inside of the container 100, 600 against the lower wall 110, 610 of the containers 100, 600, where the container 600 and its lower wall are shown in FIGS. 61 and 6J. This internal band anchor 462, like the external band anchor 460, is an optional (non-required) component within the container.

This protruding section of band 456 is dimensioned (shaped and sized) so that it can be bonded with another section of band that is likewise anchored by another second internal band anchor 462 (not shown here) that is embedded at another location into the lower wall 110, and where the other (another) location is preferably more proximate to another side wall 210*a*, having a broad side that is oriented parallel to the broad side of the side wall 210*c*. The first internal band anchor 462 that is shown here, being more proximate to the broad side wall 210*c*, than the second internal band anchor, not shown here.

Like the band anchor 460, the band anchor 462 is preferably made from a rigid and strong material, and optionally made from a metallic material, such as steel, for example. In some embodiments the band anchor which is shaped as a cylinder, is dimensioned to be ⅜ inches in diameter and 3 inches in length. The length of the cylinder shape of the band anchor 460 being greater than a width of a band for which it is attached.

Figure 5A:
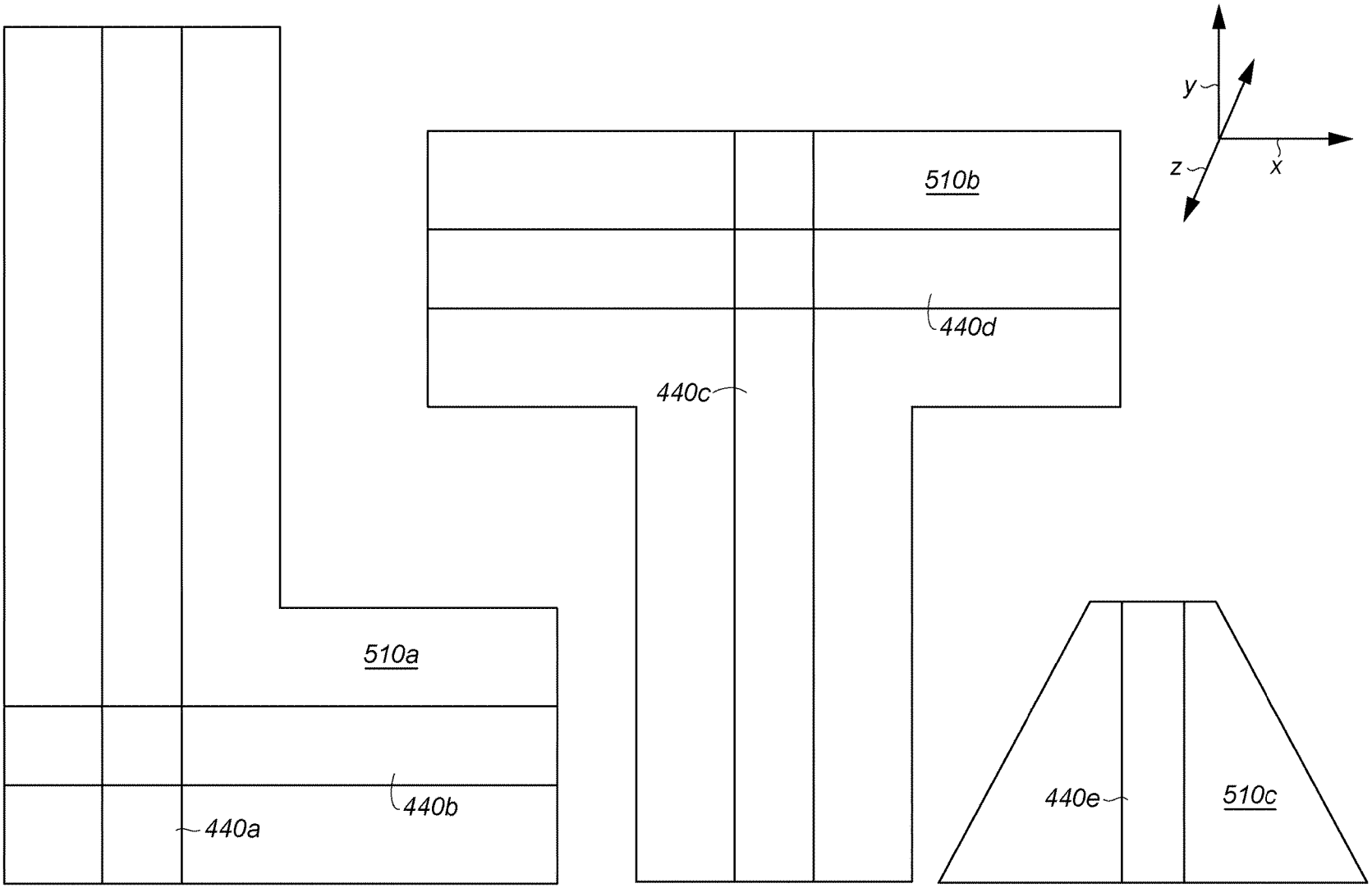
FIGS. 5A and 5B (FIGS. 5A-5B) illustrate a top-down viewing perspective of a set of atypically shaped containers and their physical arrangement within a storage space.
Figure 5B:
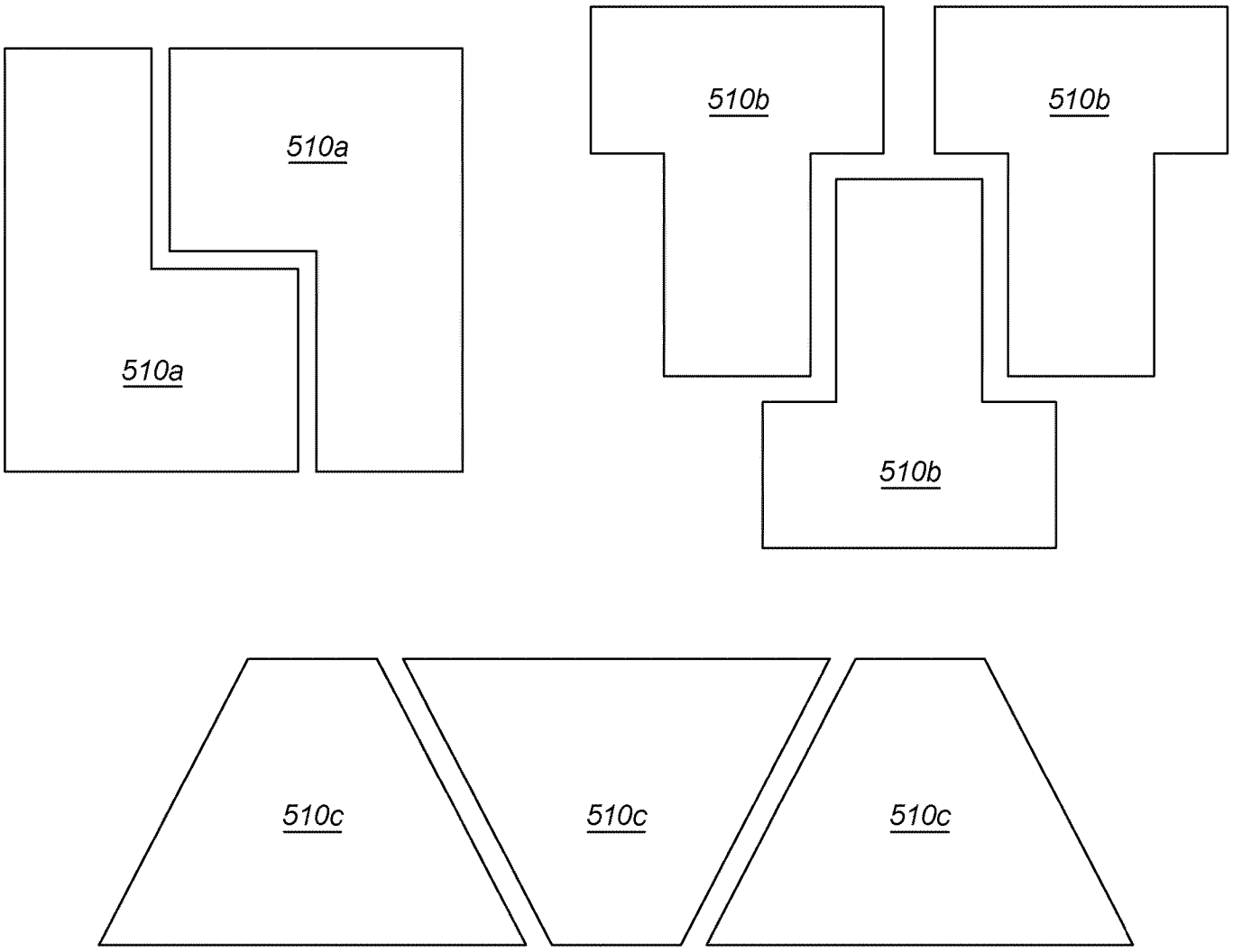

FIGS. 5A-5B illustrate a top-down viewing perspective of a set of atypically shaped containers and their physical arrangement within a storage space, in accordance with the invention.

FIG. 5A illustrates a top-down viewing perspective of containers 510*a*-510*c* that are dimensioned into atypical shapes. As shown, container 510*a* is dimensioned as an "L" shaped structure, and the container 510*b* is dimensioned as a "T" shaped structure, and the container 510*c* is dimensioned as a modified triangle shaped structure.

Container 510*a* is custom dimensioned to store an "L" shaped object as content for shipping. Such an object could be a device, such as an "L" shaped electrical bus bar, for example. The container itself 510*a*, can be dimensioned (tailored) to surround such content in a manner to minimize an amount of remaining excess storage space within the interior of the container 510*a*, so as to maximize the efficiency of the storage of content within the container 510*a*, with respect to a utilization of three-dimensional space within the container 510*a*.

The invention does not require that a container be dimensioned in a symmetrical way. For example, the "L" shape that is shown here is asymmetrical in shape. Like that shown in FIGS. 4A-4C, a tensile force can surround and be applied to the container 510*a* via one or more bands 440*a*-440*b*, to seal any content that is stored within the container 510*a*.

Container 510*b* is custom dimensioned to store a "T" shaped object as content for shipping. The container itself 510*b*, can be dimensioned (tailored) to surround such content in a manner to minimize an amount of remaining excess storage space within the interior of the container 510*b*, so as to maximize the efficiency of the storage of content within the container 510*b*, with respect to the utilization of three-dimensional space within the container 510*b*.

Although the "T" shape shown here happens to be a symmetrical shape, the invention can be practiced with non-symmetrical shapes, including with a non-symmetrical "T" like shapes. Like that shown in FIGS. 4A, 4B and 4C (FIGS. 4A-4C), a tensile force can surround and be applied to the container 510*b* via one or more bands 440*c*-440*d*, to seal any content that is stored within the container 510*b*.

Container 510*c* is custom dimensioned to store a triangle like shaped object as content for shipping. The container itself 510*c*, can be dimensioned (tailored) to surround such content in a manner to minimize and amount of remaining of excess storage space within the interior of the container 510*c*, so as to maximize the efficiency of the storage of content within the container 510*c*, with respect to the utilization of three-dimensional space within the container 510*c*.

As shown here, the actual shape of the container 510*c* is a modified equilateral triangle where one of the three corners of this triangle is cut away to create a short side that is oriented parallel to an existing and opposite side of this triangle. The existing and opposite side of this triangle being longer in length than the short side. This modification enables a band 440*e* to straddle these two opposite and parallel sides of this modified triangular shape, in order to surround both the upper wall 310 and lower wall 110 of this type of container 510*c*.

Although this modified triangular shape shown here happens to be a symmetrical shape, the invention can be practiced with shapes based upon non-equilateral triangles and/or non-symmetrical shapes, including such as a non-symmetrical triangle like shape. Such non-standard shapes can be modified, like shown here, to better accommodate wrapping of a band 440 or a belt to apply a tensile force to the non-standard shaped container. Like that shown in FIGS. 4A-4C, a tensile force can be applied to the container 510*c* via at least one band 440*e*, to seal the content within the container 510*c*.

FIG. 5B illustrates a top-down viewing perspective of containers 510*a*-510*c* that are arranged for efficient usage of three-dimensional space that is external to the containers. As shown, two "L" shaped containers 510*a* are spatially arranged to make efficient use of three-dimensional space that is external to these containers 510*a*. Likewise, three "T" shaped containers 510*b* are spatially arranged to make efficient use of three-dimensional space that is external to these containers 510*b*. And, three modified triangle shaped containers 510*c* are spatially arranged to make efficient use of three-dimensional space that is external to these containers 510*c*.

Furthermore, these containers 510*a*-510*c* are stackable because the upper walls 310 and lower walls 110 are designed to be parallel to each other, and can be placed to lay upon a floor, and upon each other, within a volume of space between a floor and a ceiling within a volume of space within which these container 510*a*-510*c* are stored.

In one use scenario, apples are picked from trees and placed into baskets. These baskets, although useful for gathering apples, are generally not stackable. The picked apples can be transferred from the baskets and placed into one or more containers 100, 600 which are stackable. These containers 100, 600 can be placed upon a pallet to be transported via a forklift to a truck, train, ship and/or airplane, for example. FIG. 6A illustrates a top-down cross-sectional viewing perspective of a container corner component 650, which is also referred to herein as a corner component 650. This corner component 650 is designed to construct a portion of a container and is designed to physically engage each of two adjacent side walls 630*a*-630*b* of a container. Each of the adjacent side walls 630*a*-630*b*, includes grooves 632*aa*-632*bb*, which are designed to engage a protrusion 656*a*-656*b* of and from the corner component 650. Each of the side walls 630*a*-630*d* are rectangular and planar in shape, and each have two broad (and) opposing sides, and each have a plurality of edge sides that are located in between each of their two (and) broad opposing sides.

Preferably, this corner component 650 is made from a material that is recyclable, such as from a type of wood (for example, from pine, Douglas fir, spruce, oak, particle board (OSB) etc.), or made from a polymer-based material or from a composite type of material, for example. Preferably, this corner component 650 is designed to be, by itself, self-standing during construction of a container, to facilitate more predictable and time efficient construction of the container.

Also, notice that this corner component 650 is designed so that there is no requirement that there be direct physical contact between two adjacent side walls 630*a*-630*b*, such as shown in FIG. 2C, for example. And further, this corner component 650 does not require employment of hardware fasteners, such as for example, clips, staples, nails or screws to attach to or construct such a portion of a container. Such hardware fasteners are typically made from a metal alloy and typically introduce a variety of types of materials that are different from that of the material for the remainder of the container itself, causing more complex circumstances for recycling activity.

FIG. 6B illustrates a more detailed top-down cross-sectional viewing perspective of a container corner component 650, relative to that of FIG. 6A. As shown, this corner component 650 has peripheral (outer) wall portion 652 that is separated into two separate portions 652*a*-652*b* that together form an 'L' shaped right angle, from this viewing perspective. Each portion of the outer wall 652*a*-652*b* of the corner component 650 has an exterior surface that faces away from the remaining portion of the corner component 650. Each of these exterior surfaces intersect each other at about (approximately) a 90-degree (right) angle.

This 'L' shaped pair of exterior surfaces of the outer wall portion 652 of the corner component 650 is referred to herein as the outer or outside portion 652 of the corner component 650. A remaining portion of the corner component 650, referred to herein as an inner or inside portion 658 of the corner component 650, is joined to the outside portion 652 of the corner component 650. Preferably, the corner component 650 is cut from one piece of stock material, so that both the outer portion 652 and inner portion 658 portions of the corner component 650 reside as one whole single, rigid and uniform (monolithic) corner component 650.

This inner portion 658 of the corner component 650 has a surface 658*a* that is cut in a diagonal direction relative to the pair of exterior surfaces of the 'L' shaped outer wall 652*a*-652*b*. This surface 658*a* faces towards a northeast direction. This northeast direction being directed towards about (approximately) a 45-degree angle relative to, the south facing direction, and the western facing direction, of the two exterior facing surfaces of the outer wall 652*a*-652*b* of the outer portion 652 of the corner component 650.

The inner portion 658 of the corner component 650 further includes two cavities (slots) 654*a*-654*b* that are each designed for receiving and physically engaging an outer edge of a side wall 630*a*-630*d* (See FIG. 6C). A first cavity 654*a* has an opening that faces towards a north direction. This first cavity 654*a* is also located adjacent to a first protrusion 656*a* that protrudes towards a west direction. This first protrusion 656*a* is designed to be inserted into a channel groove 632*aa* that is cut into a side wall 630*a* that is designed to be inserted into the first cavity 654*a*. The south facing edge of the side wall 630*a* is designed to be inserted into the cavity 654*a* while being moved in a direction that is parallel to a Z axis, which is a direction that is perpendicular to a plane defined by the intersection of the X and Y axes, and also perpendicular to a plane defined by the surface of this drawing.

In other words, the side wall 630*a* is lifted and disposed above the slot 654*a* of the corner component 650, and then the side wall 630*a* is slid downwards (towards the direction of gravity) so that the south edge of the side wall 630*a* slides into the slot 654*a* of the corner component 650, and so that the protrusion 656*a* of the corner component 650 enters and physically engages the channel 632*aa*, of the side wall 630*a*. The side wall 630*a*, is designed (configured) to be slid further in a downward direction to be inserted into a channel 614, of the lower wall 610, as shown in FIG. 6C. This channel 614 of the lower wall 610 is designed (configured) to receive and restrict movement of a lower edge of the side wall 630*a*.

Likewise, a second cavity 654*b* has an opening that faces towards an cast direction. This second cavity 654*b* is also located adjacent to a second protrusion 656*b* that protrudes in a south direction and that is designed to be inserted into a channel 632*da* that is cut into a side wall 630*d* that is configured to be inserted into the second cavity 654*b*.

Likewise, the side wall 630*b* is slid downwards (towards the direction of gravity) so that the west edge of the side wall 630*b* slides into the slot 654*b* of the corner component 650, and so that the protrusion 656*b* of the corner component 650 enters and physically engages the channel 632*ba*, of the side wall 630*b*. The side wall 630*b*, is designed (configured) to be slid further in a downward direction to be inserted into a channel 614, of the lower wall 610, as shown in FIG. 6C. This channel 614 of the lower wall 610 is designed (configured) to receive a lower edge of the side wall 630*b*.

The side walls 630*a*-630*d* are each modified to include a channel 632*aa* and 632*da*, respectively. The channels 632*aa*-632*da* are each located and sized and shaped (dimensioned) to receive each respective protrusion 656*a*-656*b*, when an edge of the side wall 630*a*-630*b* respectively, is inserted in (along) a direction that is parallel to the Z axis and passing (sliding) into each respective cavity 654*a*-654*b* parallel to that direction. The Z axis being towards the direction of gravity and directed perpendicular to a plane that is defined by the combination of the X and Y axes and defined by the surface of this drawing.

This engagement between the corner component 650 and a side wall 630*a*-630*d* is designed to cause restriction of movement of a side wall 630*a*-630*d* while it is engaged with the corner component 650, in order for the side wall 630*a*-630*b* to move (slide) in a direction (upwards/downwards) along an axis of gravity that is oriented parallel to the direction of gravity, and in order to restrict movement of the side wall 630*a*-630*d* in a direction that is other than a direction that is parallel to the axis of gravity, while the container 600 is standing (disposed) upright, with respect to the direction of gravity.

In this embodiment, the portions 652*a*-652*b* of the outer wall 650 are each approximately 15/32 of an inch in thickness, where the thickness of the portion 652*a* of the outer wall 652 is measured parallel to the X axis, and where the thickness of the portion 652*b* of the outer wall 652 is measured parallel to the Y axis. The outer surface of the portion 652*a* of the outer wall 652 measures about 2.5 inches as measured parallel to the Y axis. The outer surface of the portion 652*b* of the outer wall 630 measures about 2.5 inches as measured parallel to the X axis.

The side walls 630*a*-630*d* are also each approximately 15/32 of an inch in thickness. The thickness of the side wall 630*a* is measured in a direction that is parallel to the X axis. The thickness of the side wall 630*d* is measured in a direction that is parallel to the Y axis. Notice that the side walls 630*a*-630*d* are each less thick, by (16/32 inch−15/32 inch=1/32 inch) a margin of one thirty-second (1/32) of an inch, than the thickness, being the short dimension of, each of the respective cavities 654*a*-654*b*, that they are configured (designed) to be inserted into.

Also in this embodiment, the first cavity 654*a* has a short (width) dimension, as measured parallel to the X axis, equal to 16/32 (0.5) inches. This short (width) dimension, is measured along a west facing inner wall of the cavity 654*a* that abuts the protrusion 656*a* that is located adjacent to the north facing opening of the first cavity 654*a*.

The first cavity 654*a* also has a long (length) dimension, as measured parallel to the Y axis, and as measured from the north facing back inner wall of the first cavity 654*a* to the opening of the first cavity 654*a*, where the opening of the first cavity is located adjacent to the protrusion 656*a* adjacent to the opening of the first cavity 654*a*. This long dimension is equal to ¾ (0.75) inches. This long dimension can also be measured along an inner wall which faces in a west direction and that abuts the back inner wall and abuts up to and not beyond the protrusion 656*a*.

The protrusion 656*a* has a short dimension, as measured parallel to the X axis, equal to 2/32 (0.625) inches, and has a long dimension, as measured parallel to the Y axis, equal to 4/32 (0.125) inches.

Likewise, in this embodiment, the second cavity 654*b* has a short (width) dimension, as measured parallel to the Y axis, equal to 16/32 (0.5) inches. This short dimension, is measured along a short and cast facing back inner wall within the second cavity 654*b*. The second cavity 654*b* also has a long (length) dimension, as measured parallel to the X axis, which is also equal to ¾ (0.75) inches. This long dimension is measured along a long inner wall which is south facing and that abuts the short back inner wall and abuts up to and not beyond the protrusion 656*b*. The protrusion 656*b* has a short dimension, as measured parallel to the Y axis, equal to 2/32 (0.625) inches, and has a long dimension, as measured parallel to the X axis, equal to 4/32 (0.125) inches.

The diagonal surface 658*a* of the inner portion 658 of the corner component 650 that faces in a northeast direction, has a horizontal (width) dimension, as measured along its surface in a northwest to southeast direction as shown here, equal to about (approximately) 2.75 inches. This surface has a long (length) dimension that is measured parallel to the Z axis, and parallel to a direction of gravity, when this corner component 650 is incorporated into a manufactured container that is being disposed and oriented in an upright manner, as it is designed.

This long dimension of this surface 658*a* is dependent upon the manufactured length of the long dimension of the corner component itself 650. The manufactured length of the corner component 650 depends upon the intended height of the container within which the corner component 650 is to be incorporated. In other words, the corner component 650 is designed to have a long dimension that is measured parallel to the direction of gravity, when the corner component 650 is incorporated into a container that is disposed in an upright manner.

FIG. 6C illustrates a top-down viewing perspective of a partially constructed container, including one container corner component 650, that is attached to two side walls 630*a*-630*b*, and disposed (mounted) on an upper surface of a lower wall 610, being a type of lower wall 610 that is incorporated into a container including corner components 650.

The upper surface portion of the lower wall 610 that is located between the outer perimeter of the lower wall 610 and the channel 614 of the lower wall 610, is referred to herein as a perimeter plateau 612 of the lower wall 610. Separately from the perimeter plateau 612, the upper surface portion of the lower wall 610 that is surrounded by and located inside of the channel 614 of the lower wall 610, is referred to herein as a center plateau 616 or as a central plateau 616 of the lower wall 610. This center plateau 616 includes a center point location 618.

As shown here, an outer perimeter of the outer wall 652 of the corner component 650 is disposed upon and aligned with, an outer perimeter of south west corner of the lower wall 610. Accordingly, the outer wall 652 of the corner component 650 is disposed upon and aligned with the perimeter plateau 612 of the lower wall 610. Furthermore, each of the side walls 630*a*-630*b* are inserted into the channel 614, like that shown in FIG. 2A.

The channel 614 of the lower wall 610, is designed to receive a lower edge of a side wall 630, to restrict the side wall 630 from moving in a lateral direction, where this lateral direction is not parallel to a long dimension of the channel 614, within which the side wall 630 is inserted. The lateral direction, being in direction that is generally parallel to a plane defined by the intersection of the X and Y axes.

The channel 632 of the side wall 630, is designed to receive a protrusion 656 from the corner component 650, to restrict the side wall from moving away from the corner component 650, in a lateral direction and in a direction that is generally parallel to the long dimension of the channel 614, within which the side wall 630 is inserted.

FIG. 6D illustrates a top-down viewing perspective of a four-wall constructed container, including four container corner components 650*a*, 650*b*, 650*c* and 650*d* (650*a*-650*d*), that are each physically engaged with (attached to) two of four side walls 630*a*, 630*b*, 630*c* and 630*d* (630*a*-630*d*).

As shown here, side wall 630*a* is attached to corner components 650*a*-650*b*, side wall 630*d* is attached to corner components 650*b*-650*c*, side wall 630*c* is attached to corner components 650*c*-650*d*, and side wall 630*d* is attached to corner components 650*d*-650*a*, in the same manner as corner component 650 described earlier in connection with side walls 650*a* and 650*d*. What is not shown here, is how the corner components 650*a*-650*d* are each physically engaged (attached) with the lower wall 610, as shown in FIGS. 6E-6H.

This lower wall 610, like the upper wall 640, is rectangular and planar in shape, and has two broad (and) opposing sides, and it includes a perimeter plateau 612. These two broad (and) opposing sides of the lower wall 610 include an upwards facing side (as shown here) and a downwards facing side (not shown here).

FIG. 6E illustrates a side viewing perspective of the corner component 650 shown in FIGS. 6A-6B. A shown, this embodiment of the corner component 650 is substantially taller than it is wide, from this viewing perspective. For example, to support typical shipping demands, the corner component is configured to typically be 2-8 feet in height. However, the height dimensions of this corner component can be configured to reside outside of this 2-8 foot range, and cross above 8 feet or cross below 2 feet boundary of this range.

As shown, the inner portion 658 of the corner component 650 is extended in two opposite vertical directions, being downwards and upwards. An extension of an inner portion 658 of the corner component 650, in either direction, downwards or upwards, is also referred to herein as a vertical extension 651*x*-651*y* of the inner portion 658 of the corner component 650.

First, this inner portion is extended in a downward direction and below a central portion 651*a* of the corner component 650. This extension is referred to herein as an inner portion lower extension 651*x*, or as a lower extension 651*x*, of the corner component 650. Second, this inner portion is extended in an upward direction and above a central portion 651*a* of the corner component 650. This extension is referred to herein as an inner portion upper extension 651*y*, or as an upper extension 651*y*, of the corner component 650.

The lower extension 651*x* is designed (configured) to be inserted into a corner of the lower wall 610, the topology of which is shown in detail in FIG. 6E. The upper extension 651*y* is designed (configured) to be inserted into a corner of an upper wall 640, the topology of which is also shown in detail in FIG. 6E.

For this embodiment, the lower wall 610 and the upper wall 640 share the same dimensions, being the same shape and size, and further share, the same three-dimensional topology, including the routed portions of each wall, being the channel portion 614, of each of the lower wall 610 and of the upper wall 640, which are designed and manufactured to mirror each other.

Such mirroring means that the channel 614 has a same shape, size and location for both the lower wall 610 and the upper wall 640, so that when the side walls 630*a*-630*d* are inserted into both the channel 614 of the lower wall 610 and of the upper wall 640, the side walls 630*a*-630*d* are oriented perpendicular to each of the lower wall 610 and the upper wall 640, and while the lower wall 610 and the upper wall 640 are oriented parallel to each other.

When the corner components 650*a*-650*d* are attached to a side wall 630*a*-630*d*, and attached to a lower wall 610 and/or an upper wall 640, movement of that side wall 630*a*-630*d* is further restricted along an axis that is parallel to the direction of gravity, while the container 600 is standing (disposed) upright with respect to the direction of gravity. This is because each of the lower wall 610 and upper wall 640, obstructs the sliding of the side wall 630*a*-630*d* along an axis that is parallel to the direction of gravity, and essentially, arresting the movement of the side wall 630*a*-630*d* in any direction when it is fully physically engaged with the remaining components of the container, being the lower wall 610, upper wall, and two adjacent corner components among the four (4) corner components 650*a*-650*d*.

FIG. 6F illustrates an unobstructed top-down viewing perspective of an embodiment of the lower wall 610 of the container of the invention. As shown, the lower wall 610, is generally rectangular in shape. However, this overall shape could be that of a square, or else that of another rectangle that has a more extreme difference between its long dimension (shown here as being parallel to the X axis) and its short dimension (shown here as being parallel to the Y axis).

The lower wall 610 has a perimeter plateau portion 612 that surrounds a channel portion 614 of the lower wall. The channel portion 614 surrounds a central plateau portion 616 of the lower wall. The perimeter plateau 612 and the central plateau 616 each have a higher elevation within the lower wall 610, while the channel portion 614, has a lower elevation within the lower wall 610, where the elevation is measured as a distance above the surface of the earth. In this embodiment, the lower wall 610 has an overall (maximum) thickness that is equal to about 15/32 of an inch. In this embodiment, the channel portion 614 has an elevation that is 8/32 inches lower than that of the perimeter plateau 612 and that of the central plateau 616, of the lower wall 610.

Also as shown, the channel 614 has four (4) corner portions that are each shaped to receive the lower extension 651*x* of inner portion 658 of the corner component 650 of FIG. 6E. These corner portions are located at the southwest, northwest, northeast and southeast corners of the channel 614 of the lower wall 610. Each of these corner portions of the channel 614 of the lower wall 610, and of the upper wall 640 which mirrors the lower wall 610, are configured (designed) for receiving an extended (inner) portion of a corner component 650.

Preferably, each corner portion of the channel 614 of the lower wall 610, is shaped and sized so that the lower extended portion 651*x* of each corner component 650 fits within, and preferably friction fits within, and into each corner portion of the channel 614 of the lower wall 610. Likewise, the channel 614 of the upper wall 640, is shaped and sized so that the upper extended portion 651*y* of each corner component 650 of FIG. 6E, fits within, and preferably friction fits within, and into each corner portion of the channel 614 of the upper wall 640. In between each corner portion of the channel 614, there is a uniform width portion of the channel 614 that is located, shaped and sized to receive a lower edge of each side wall 630. Preferably, each side wall also friction fits into the channel 614 portion of the lower wall 610.

FIG. 6G illustrates an unobstructed perspective view of a second embodiment of the lower wall 610 including apertures (slots/holes) 670*a*, 670*b*, 670*c*, 670*d*, 670*e*, 670*f*, 670*g*, 670*h*, 670*i*, 670*j*, 670*k*, 670*l* (670*a*-670*l*) that are designed (configured) to receive a band 446 or strap 442 (not shown here). This embodiment of the lower wall 610 is proportioned so that it is squarer in shape than the lower wall 610 of FIGS. 6C-6D and 6F, and further, this embodiment of the lower wall 610 is much larger in size in relation to the size of the embodiment of the lower wall 610, as it is shown in FIGS. 6C, 6D and 6F, for example.

Notice that there is no physical barrier in between the channel 614 and each aperture 670*a*-670*l*. This feature of the invention enables a band 440 or strap 440 to make physical contact with a side wall 630, when a container is fully assembled (constructed). Also notice that the band 440 or strap 440 resides inside of the outer perimeter of the lower wall 610, so that it is not disposed and does not protrude all the way to the perimeter of the constructed container 600, reducing a likelihood that such a band 440 or strap 440 could become entangled or "snagged" with some other object that is located outside of the constructed container 600.

FIG. 6H illustrates two corner components 650*a*, 650*d* that are disposed above the lower wall 610 of FIG. 6G. As shown, corner component 650*a* is positioned just prior to being inserted into a southwest corner of the channel 614 of the lower wall 610, while corner component 650*d* is likewise positioned just prior to being inserted into a southeast corner of the channel 614 of the lower wall 610. Actually, the lower extension 651*x* portion of each corner component 650*a*, 650*d* is inserted into each of the respective southwest and southeast corners of the channel 614 of the lower wall 610.

Preferably, the dimensions of the lower extension 651*x* and of each of the respective southwest and southeast corners of the channel 614 are located, shaped and sized so that the insertion of the lower extension 651*x* friction fits into the channel 614, and so that such a friction fitted insertion causes each corner component 650*a*-650*b* to stand upright by itself, and resistant to tipping over, while being inserted into each respective southwest and southeast corner of the channel 614, and while a plane defined by the lower wall 610 is oriented parallel to the surface of the earth and oriented perpendicular to the direction of gravity. Likewise, the corner components 650*b*-650*c* are inserted into the northwest and north cast corners respectively, in the same manner as described for corner components 650*a*-650*d*.

FIG. 6I illustrates an embodiment of an assembled (constructed) container 600 of the invention. This particular embodiment of the container 600 is referred to herein as a zero-fastener container, and is also referred to herein as being a fastener-less container, meaning that the container 600 shown here, as assembled (constructed) includes only container components excludes fasteners.

As defined herein, fasteners are components that are other than the container components that are described herein as forming the structure of the container 600. For this embodiment of the container 600, these container components include a lower wall component 610, four (4) corner components 650*a*-650*d*, four (4) side wall components 630*a*-630*d* and an upper wall 640 component. Examples of fasteners include, but not limited to, penetrating fasteners, which include nails, screws, staples, rivets and the like, Fasteners can also include non-penetrating fasteners, such as clamps, clips, bands, straps and belts and the like. As shown and described here, this container 600 includes no installed fasteners, penetrating or non-penetrating, and in accordance with its design, there is no requirement to install any fasteners to assemble (construct) and use this container 600.

As shown here, this container 600 is shown in a closed configuration, meaning that the structure of this container 600 is closed, and enclosing its content. In this configuration, the upper wall 640 is attached to the remaining container components that are assembled together within this container 600. In this closed configuration, one or more items (content) may or may not be enclosed (stored) within this closed container 600.

As shown here, the constructed container includes four (4) corner components 650*a*-650*d*, of which three (3) of these corner components 650*a*-650*b* and 650*d*, are at least partially visible from this viewing perspective. The container 600 also includes (4) side walls 630*a*-630*d*, of which two of these side walls are visible 630*a*-630*b* from this viewing perspective. The container 600 further includes a lower wall 610 and an upper wall 640, each of the lower wall 610 and the upper wall 640 having a same overall shape and size and each of these walls 610,640 including a channel 614 that mirrors the size, shape and relative location of the channel 614 of the other wall 640,610.

As a result, an entire outer edge of each of the side walls 630*a*-630*d* of this container 600 can be inserted into a channel of both the lower wall 610 and the upper wall 640, and as designed and when inserted, these walls 630*a*-630*d* are each oriented perpendicular to both the lower wall 610 and the upper wall 640, and oriented parallel to the direction of gravity, if and when the container 600 is standing (oriented) upright with respect to the direction of gravity. The direction of gravity being parallel to the Z axis.

Alternatively, when the upper wall 640 is removed from this container 600, this container is said to be in an open configuration. When in an open configuration, the interior of this structure (container) is visible from a viewing perspective above the container 600, and any items that are stored inside of the container 600 are visible from this viewing perspective.

FIG. 6J illustrates the assembled (constructed) container 600 of the invention of FIG. 6I, in combination with one installed band fastener 446. This particular embodiment of the invention is referred to herein as a one-fastener container, meaning that the container shown here, as constructed, includes only one installed fastener in combination with other container components. This one installed fastener being a heat bonded band 446 that is installed under tension while surrounding the container 600 and passing though apertures (passageways, slots/holes) 670*a*-670*b*,670*c*, 670*d*, 670*c*, 670*f*, 670*g*, 670*h*, 670*i*, 670*j*, 670*k* and 670*l* (670*a*-670*l*) within the lower wall 610 and upper wall 640.

Alternatively, a strap, such as a ratchet strap 442 could instead be or additionally be installed around this container 600. Such a strap 442 could be installed parallel to the heat bonded band 446 or instead installed perpendicular and/or not parallel to the installed heat bonded band 446. As installed, this fastener 446 encircles (surrounds) the container 600 and applies a constricting (pressing/squeezing) force to the container 600 in order to strengthen the bonding forces between the components of the container 600.

As shown, this container 600 is shown in a closed and sealed configuration, meaning that the structure of this container 600 is closed, and it is closed because an upper wall 640 is attached to the remaining components that are assembled together within this container 600.

In this closed configuration, one or items (content) may or may not be enclosed within this closed container 600. Furthermore, this container 600 is in a sealed configuration, meaning that the container is sealed via the heat bonded band 446, and this heat bonded band is designed to be severed to be uninstalled (removed) from the container.

The container 600 as shown here, when incorporating the walls of the container 600, are made from 15/32 inches thick plywood, and the corner components are cut from 3×3 inch stock pine, having dimensions of 30×30×30 inches, with a plastic liner, is designed to be capable of storing and carrying content, when disposed onto a pallet, for example, of at least 2.5 cubic feet of sandy soil. Such content would weigh about 280 pounds. Optionally, the lower wall 610, and other walls 630*a*-630*d* can be made from plywood and designed with wider dimensions, such as for example, ¾ inches thick plywood, which should enable this container 600 to carry at least 400 pounds. With respect to plywood, the thickness of the walls could be further widened to ⅝ inches, yielding even greater content carrying capacity for this container 600. Even if the area of the lower wall 610 is reduced by a factor of 4, and the height of the container is reduced by a factor of 3, such a relatively small container with walls made of plywood that is 15/32 inches thick should be able to store and carry content, such as sandy soil, weighing at the very least 70 pounds or more.

When the container 600 is shipped from a sender (sending entity) to a receiver (receiving entity), the receiver typically expects the container 600 to be sealed as evidence that the content was not tampered with during its transport (transit) from the sender to the receiver. If the heat bonded band has been severed, or another portion of the container has been damaged prior to the container 600 being received by the receiver, this indicates evidence that some type of tampering of the container and its content has occurred prior to being received by the receiver.

Installation of this type of fastener 446 under tension applies a constricting (pressing, squeezing) force to the container 600. As shown in FIGS. 61 and 6J, the assembled (constructed) container includes four (4) corner components 650*a*-650*d*, of which three (3) of these corner components 650*a*-650*b* and 650*d*, are at least partially visible from this viewing perspective. The container 600 also includes (4) side walls 630*a*-630*d*, of which two of these side walls are visible 630*a*-630*b* from this viewing perspective. The container 600 further includes a lower wall 610 and an upper wall 640, each of the lower wall 610 and the upper wall 640 having a same overall shape and size and each of these walls 610,640 including a channel 614 that mirrors (having a same location, shape and size of) the channel 614 of the other wall 640,610.

In accordance with the design of these container components, a straight outer edge of each of the side walls 630*a*-630*d* of this container 600 is inserted into a channel of both the lower wall 610 and the upper wall 640, and when inserted, these walls 630*a*-630*d* are each oriented perpendicular to both the lower wall 610 and the upper wall 640, and oriented parallel to the direction of gravity, if and when the container 600 is oriented upright with respect to the direction of gravity. The direction of gravity being parallel to the Z axis.

In one type of use scenario, a container 600 is located inside of a business facility or a home or another type of facility that is trusted by an owner of the container 600. This container 600 is employed to store one or more items. Such items may or may not require additional security beyond that provided by the assembled and unsealed container 600.

If the owner (owning entity) determines that storage of such items require additional security, then a locking (lockable) ratchet strap 452 can be installed upon the container 600, so that the contents of the container can be accessed by a person having a key to a lock of the locking ratchet strap 442. Without a key, someone may be forced to damage the container 600 to access the items (content) that is stored within it.

Alternatively, if the container 600 remains stationary, and if such items stored within the container 600 do not require additional security, then perhaps a further installation of a band or strap 442 would not provide an additional substantial benefit for the use of this stationary container 600.

However, if such a container 600 is to be transported to another location, then the container 600 will likely be subject to additional physical forces, relative to the physical forces normally placed upon the container during its stationary use, being its normal use when the container is stationary. Such additional physical forces including such as forces caused from lifting and/or being placed upon a hand truck and/or a forklift pallet, and subject to forces caused by a hand truck and/or fork lift machine or other type of moving machinery, for moving (transporting) the container 600 and its contents to another location.

In this type of circumstance, it would be beneficial to further constrict the container 600 via a band, belt or strap 442 in order to strengthen the container 600 as an enclosure for the items that are enclosed within it, during its transport from a first location to a second location.

However, if during the transport of the container 600, the container remains in the possession of an entity (person) owning the container, then no additional security might be required during the transport of the container 600, and installation of a ratchet strap may be what is required to constrict the container 600, without necessarily locking the container.

However, if an entity other than the owning entity that owns the container 600, is to take possession of the container 600 during its transport, then additional security will typically be required to protect the container 600 and its content while the container 600 is being transported and in the possession of the transporting entity.

In this type of transport use scenario, the container 600 could be used to enclose one or more items that are being sold by the owning entity, acting as a sending entity, to a receiving entity of the container 600.

In this circumstance, it would be appropriate to use a heat bonded band 446 to seal the container 600, so that the container 600 is constricted and secure during its transport, and so that the receiving entity can receive the container 600 and have reason to believe that the container 600 and its contents were not damaged or tampered with during transport of the container 600, prior to the container being received by the receiving entity, providing that the container 600 appears undamaged and providing that the heat bonded band 446 appears to be intact and not severed, upon being received by the receiving entity.

In a variation of the above-described use scenario, the owning entity and the sending entity and the receiving entity could be the same entity. This could be a circumstance where the container 600 is being transported between two different facilities that are owned by the same owning entity. In this circumstance, it could be appropriate to use a lockable (locking) ratchet strap 452 that could be locked and unlocked by the same entity, being the owning and sending entity and receiving entity. This lockable ratchet strap 452 would not be unlockable by the transporting entity.

As described above, whether or not to seal the container 600, depends upon how the container is being used. Sealing the container provides a necessary benefit during transport of the container, for example, via truck, train, ship, airplane, just for example.

In some embodiments, the invention provides for a method for sending (transporting) items from a first location to a second location. This method including actions of providing an assembled container that is designed to be disassembled and reassembled and that requires no installation or removal of penetrating fasteners, and that requires no application or removal of adhesive for assembly or disassembly of the assembled container; and the action of storing items within said container; and closing and sealing the container with a band or strap, and arranging for transportation of the container from a first location to a receiver at a second location, and receiving the container in a disassembled form from the receiver at the second location, and reassembling the container for reuse of the container.

Optionally, an action of performing a repair upon the container in disassembled form, should a repair be required (if applicable), after the action of receiving, and sending a monetary credit to the receiver in exchange for the receiver sending the container in disassembled form back to the sender at the first location.

In some embodiments, the invention provides for a method for receiving items being sent from a first location to a second location, including actions of receiving at a second location from a sender at a first location, a container in assembled, closed and sealed form, the container being designed to be disassembled and reassembled, and designed to require no removal of penetrating fasteners, nor removal of adhesive for disassembly; and the action of unsealing and opening the container; and removing items from within the container, and disassembling the container; and arranging for transportation of the container in disassembled form, from the second location to the sender being located at the first location; and receiving monetary credit from the ender in exchange for the transportation of the container in disassembled form to the sender.

Referring back to FIGS. 1B-1C, the channel 120 is cut into a lower wall 110 in a pattern that forms a continuous loop that is in the overall shape of a rectangle, as shown in FIG. 1B. A cross-sectional profile of the channel 120, as shown in FIG. 1C, via figure reference numbers 120*a* and 120*c*, is also in the shape of a rectangle.

Referring back to FIGS. 6A-6B, these figures each include a cross-sectional view of a corner component 650, having an overall cross-sectional profile that appears somewhat similar to that of right triangle. As shown in FIG. 6B, this cross-section of the corner component 650 includes an outer portion 652 that further includes two outer walls 652*a*-652*b* that form a right angle, like that included within a right triangle. This cross-section of the outer portion 652 of the corner component 650 forms a shape of a letter 'L', that is symmetrical given that each outer wall 652*a*-652*b* of the outer portion 652 spans an equal distance towards two different and orthogonal directions, and spans along a perimeter, being the outer margin 612 of the lower wall 610 and upper wall 640, of the assembled container 600, in accordance with this particular embodiment of the invention.

Notice that the cross-sectional view of each of the outer walls 652*a*-652*b* of a corner component 650, has a long dimension that is oriented parallel to the Y and X axes, respectively. As stated earlier, this long dimension of each of the outer walls 652*a*-652*b*, is about 2.5 inches in length, as measured parallel to the Y axis and to the X axis, respectively, and with respect to this particular embodiment of the container 600.

As shown, the outer walls 652*a*-652*b* are each joined at a right angle, being a 90 degree (right angle) 651. This right angle 651 is itself residing at a location that is a most south-western portion of this viewing perspective of the cross-section of the corner component 650. This right angle 651 is also referred to herein as an outer corner 651, or as a corner ridge 651 or as a corner ridge line 651, of the corner component 650. This corner ridge 651 spans (ranges) in a vertical direction between the lower wall 610 and the upper wall 640, of the assembled container 600 (See FIGS. 6I-6J).

Also, corner component 650 includes an inner portion 658, including an inner surface 658*a* of inner portion 658*a* of the corner component 650, that is faces away from the corner ridge 651 and that faces diagonally into the volume of storage space provided the container 600, and towards a north-easterly direction, as shown in this FIGS. 6A-6B. This inner surface 658*a* has a diagonal orientation relative to the orientation of the outer walls 652*a*-652*b*, and it 658*a* appears to be oriented somewhat like a hypotenuse side of a right triangle.

Also notice that a measurement of a distance (length) 653, as measured diagonally between the corner ridge 651 and the inner surface 658*a*, has a length that is slightly less than a measured length of the long dimension (2.5 inches) of either of the outer walls 652*a*-652*b* of the corner component 650. In other words, this southwest to northeasterly diagonal distance measurement 653 of this cross-section of the corner component 650 measures to slightly less, being about (approximately) 95 percent of the 2.5 inches in length of the long dimension span of each outer wall component 652*a*-652*b*, as shown with respect to this embodiment of the container 600.

These measurements collectively reveal a set of advantageous characteristics of the cross-sectional dimensions of the corner component 650, where the long dimension of the cross-section of each of the outer walls 652*a*-652*b* of the corner component 650, each span toward two orthogonal directions, and span away from the corner ridge 651 of the corner component 650, and along a perimeter (perimeter plateau/outer margin 612 of FIG. 6D) of the lower 610 and upper wall 640 of the container 600. Each of these orthogonal directions are directed parallel to the north and east directions, respectively, and as shown from the viewing perspective of FIG. 6B. This corner spanning distance characteristic helps to provide an enhanced resistance to an occurrence of a tipping over event, of the corner component 650, in response to a force of gravity upon the corner component 650, during a process of assembling the container 600.

Also, the diagonal distance measurement 653 indicates a limitation on how far the corner component 650 diagonally extends into the volume of storage space provided by the container 600. For example, a hypothetical and alternatively designed container corner component having a square or near square cross-sectional shape, spanning 2.5 inches away from a corner ridge 651 and towards two orthogonal directions along the perimeter of the lower and upper walls of the container, and would also diagonally extend and protrude slightly more than 3.5 inches into the storage space provided by the container 600. In other words, the alternatively designed corner component would extend more than an inch farther into the volume of storage space provided by the container, and could possibly further obstruct, and occupy significantly more storage apace, than the corner component 650 of the Applicant's invention.

Furthermore, the Applicant's corner component provides a substantial resistance to bending forces placed upon the corner component 650, given that the diagonal distance measurement 653, although slightly less than 2.5 inches, is more than 2 inches, and substantially resistant to a bending force that is generally directed parallel to the direction of the diagonal distance measurement 653.

Referring back to FIG. 6I, the assembled (joined together) container 600 includes a lower wall component 610 and an upper wall component 640. As shown, the lower wall component 610 includes a plurality of twelve (12) apertures 670*a*-670*l*. Likewise, the upper wall component 640 includes a plurality of twelve (12) apertures 680*a*-680*l*. Within the assembled container 600, each of the apertures 680*a*-680*l* in the upper wall 640 are shown as being located directly above a corresponding aperture 670*a*-670*l* in the lower wall 610, respectively. In other words, aperture 680*c* is located directly above aperture 670*c*, aperture 680*i* is located directly above aperture 670*i*, and aperture 680*l* is located directly above aperture 670*l*, etc.

As shown in FIG. 6J, a passageway including a set of apertures 670*c*, 680*c*, 680*i* and 670*i* (where 670*i* not shown from this viewing perspective), is configured to enable a belt or strap 446, when disposed within (passing through) this passageway, to form a loop for surrounding the assembled container 600. In this circumstance, and as shown here, this loop can be characterized as a vertically oriented loop formed by the belt or strap 446, because this entire loop as a whole, is oriented parallel to and along a two-dimensional plane that resides within a three-dimensional space, and where this two-dimensional plane is oriented substantially parallel to the X and Z axes as shown here, and where this plane is characterized as being a vertically oriented plane inside of a three dimensional space.

Notice that this any belt or strap 446 residing within this passageway including this set of apertures 670*c*, 680*c*, 680*i* and 670*i*, is located a distance away (apart) from a location of any side wall corner (650*a*-650*d*), where a side wall corner 650*a*-650*d* is formed via a joining of two adjacent side walls from the set of side walls (630*a*-630*d*), via corner component (650*a*-650*d*). In other embodiments of the container, the side wall corners are located where each of two adjacent side walls directly abut each other, as shown for example, in FIG. 2C.

With respect to the embodiment of FIGS. 6I-6J, the side wall 630*a* is joined with side wall 630*d* via corner component 650*a*. This corner component 650*a* forms a side wall corner 650*a* attaching to the adjacent side walls 630*a* and 630*d*, that are surrounding that corner component 650*a*. Also notice that the apertures 670*a*-670*l* and 680*a*-680*l* are each located a distance away (apart) from a location of any side wall corner (650*a*-650*d*).

Further with respect to this embodiment of FIGS. 6I-6J, the corner components 650*a*-650*d* each abuts with and joins a pair of adjacent side walls from the set of side walls 630*a*-630*d* within the container 600. Referring to FIG. 6J, notice that a band or strap 446 is disposed (positioned) within a passageway including the apertures 670*c*, 680*c* and 680*i* and 670*i* (not shown from this viewing perspective). This passageway which includes the apertures 670*c*. 680*c*, 680*i* and 670*i*, is located away (apart) from any one of the corner components 650*a*-650*d*, which each function as side wall corners 650*a*-650*d* for this embodiment of the container 600.

And as a result, any band or strap 446 that is disposed (located) within this set of apertures 670*a*-670*l* and 680*a*-680*l*, which forms a passageway, is located in between a pair of adjacent side wall corners (650*a*-650*d*). For example, corner component 650*a* is adjacent to corner component 650*b* and 650*d*, and is not adjacent to, and is instead opposite to corner component 650*c* (not shown from this viewing perspective).

This written description uses example embodiments to disclose the invention, to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

PARTS LIST

110 lower wall of a container 100
112 perimeter plateau of lower wall 110
114 channel (valley) of lower wall 110
116 central plateau of lower wall 110
118 center point location of lower wall 110
120 channel of lower wall 110
170 aperture (passageway/slot/hole) for receiving a band 446 or strap 442 for container 100
190 horizontal cross-sectional viewing perspective of the lower wall
210 side wall(s) of the container 100
212 beveled edge type of physical contact between side walls 210
214 abutting type of physical contact between side walls 210
216 notched type of physical contact between side walls 210
310 upper wall of the container 100
316 central plateau of upper wall 310
320 channel of upper wall 310
322*a* outer perimeter of channel 320
322*b* inner perimeter of channel 320
430 horizontal cross-sectional viewing perspective of container and band
440 band or strap
440*a* vertical oriented band for "L" shaped container
440*b* horizontal oriented band for "T" shaped container
440*c* vertical oriented band for modified triangle shaped container
442 ratchet strap
444 ratchet portion of ratchet strap
446 heat bonded band
448 horizontally wrapped band
452 locking (lockable) ratchet strap
456 external section of band
458 internal section of band
460 external band anchor

462 internal band anchor
510*a* "L" shaped container
510*b* "T" shaped container
510*c* modified triangle shaped container
610 lower wall of container including corner components 610
612 perimeter plateau of lower wall 610
614 channel of lower wall 610
616 central plateau of the lower wall 610
618 center point location of the lower wall 610
630 side wall of container including corner component(s) 650
632 channel (groove) of side wall 630 of container 600 including a corner component(s) 650
640 upper wall of container including corner components 610
646 heat bonded band surrounding the container of FIGS. 6A-6J
650 corner component of container 600
651 vertical extension of the inner portion 658 of the corner component 650.
652 outer wall of corner component 650
654 cavity for receiving a side wall 630 of container 600
656 protrusion of corner component 650 for engaging side wall 630
658 inner portion of corner component 650
658*a* diagonal surface of inner portion of corner component 650
670 aperture (passageway/slot/hole) for receiving a band 446 or strap 442 for container 600

What is claimed is:

1. A container for storing one or more items as content, comprising:

a lower wall having a planar shape with two broad opposing sides, one of said broad opposing sides being an upward facing side, said upward facing side including a first channel and a first outer margin;

an upper wall having a planar shape with two broad opposing sides, one of said broad opposing sides being a downward facing side, said downward facing side including a second channel and a second outer margin;

a plurality of side walls, each of said side walls having a planar shape, with two broad and opposing sides, and each side wall having a plurality of edge sides that are located in between said two broad and opposing sides; and wherein said lower wall, said upper wall and said side walls are designed to be joined together to construct an assembled container, said assembled container including a plurality of side wall corners, each of said side wall corners resulting from a joining of two side walls within said assembled container, and wherein a combination of said upper wall and said lower wall includes a plurality of apertures, each of said apertures passing through one of said first outer margin or said second outer margin, and wherein each of said apertures constituting a portion of at least one passageway, said at least one passageway being located away from said side wall corners, and configured to enable a band or strap to pass through said passageway and to form a loop to surround said assembled container.

2. The container of claim 1, further comprising a band or strap that is configured to apply a constricting force upon said assembled container, while said band or strap is disposed within said at least one passageway, and while said band or strap is surrounding said assembled container.

3. The container of claim 2, wherein said band or strap is a heat bondable band that is configured to receive a constricting force from a device, said device configured to apply said constricting force of 200 pounds or greater upon said assembled container.

4. The container of claim 2, wherein said band or strap can be a locking rachet strap.

5. The container of claim 1, wherein said assembled container includes a plurality of corner components, at least one of said corner components having a cross-sectional profile including an outer portion, said outer portion including a pair of outer walls that form a right angle and that surround a corner ridge, and wherein each of said outer walls facing away from said assembled container, and wherein said cross-sectional profile further including an inner portion, said inner portion including an inner surface that is oriented diagonally in relation to said pair of outer walls, and facing towards a volume of storage space provided by said assembled container.

6. The container of claim 5, wherein said at least one of said corner components includes a cavity and a protrusion that are designed for joining said corner component with at least one of said side walls.

7. The container of claim 6, wherein said at least one of said side walls includes a channel for receiving said protrusion of said corner component.

8. The container of claim 5, wherein said outer walls of said outer portion, each spanning for equal distances along a perimeter of a lower wall and an upper wall, and spanning away from said corner ridge.

9. The container of claim 5, wherein said inner portion of said corner component includes two extended portions that each extend in opposite directions relative to each other, and that each extend in a direction that is parallel to a long dimension of said corner component, and that each extend beyond said outer portion of said corner component.

10. The container of claim 5, wherein said outer portion is configured to be disposed upon an outer margin of said lower wall and upon an outer margin of said upper wall, within said assembled container.

11. The container of claim 5 wherein at least one of said corner components or at least one of said walls is cut from a material of a type that can be cut via a computer numerical controlled (CNC) machine.

12. The container of claim 11 wherein said material is classified as being as at least one of a reusable type of material and a recyclable type of material.

13. The container of claim 1 wherein said assembled container includes at least one external band anchor.

14. The container of claim 1 wherein said assembled container further includes at least one internal band anchor.

15. The container of claim 1 wherein said assembled container is configured to require one and only one type of fastener for sealing said assembled container, said fastener being a band or strap under tension.

16. The container of claim 1 wherein said assembled container is configured to not require installation of any type of penetrating fastener, and wherein said penetrating fastener penetrates material from which the container is made from.

17. The container of claim 16, wherein said assembled container is configured for disassembly and transportation to another location for reassembly and reuse, after unsealing said assembled container, and wherein said disassembly does not require removal of any type of penetrating fastener from said assembled container.

18. The container of claim 1, wherein said first channel and/or said second channel forming a continuous loop and having a cross-sectional profile that is of a shape of a rectangle.

19. The container of claim 1, wherein said loop is characterized as a vertically oriented loop.

* * * * *